US011319693B2

(12) United States Patent
Takahashi et al.

(10) Patent No.: US 11,319,693 B2
(45) Date of Patent: May 3, 2022

(54) CONSTRUCTION MACHINE

(71) Applicant: Hitachi Construction Machinery Co., Ltd., Tokyo (JP)

(72) Inventors: Hiromasa Takahashi, Abiko (JP); Kenji Hiraku, Kasumigaura (JP); Teppei Saitoh, Mito (JP); Syouhei Sugiki, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/276,734

(22) PCT Filed: Feb. 18, 2020

(86) PCT No.: PCT/JP2020/006185
§ 371 (c)(1),
(2) Date: Mar. 16, 2021

(87) PCT Pub. No.: WO2020/179429
PCT Pub. Date: Sep. 10, 2020

(65) Prior Publication Data

US 2022/0042279 A1 Feb. 10, 2022

(30) Foreign Application Priority Data

Mar. 6, 2019 (JP) ..... JP2019-041060

(51) Int. Cl.
*E02F 9/20* (2006.01)
*E02F 9/22* (2006.01)
(Continued)

(52) U.S. Cl.
CPC ..... *E02F 9/2012* (2013.01); *E02F 9/2203* (2013.01); *E02F 9/2228* (2013.01);
(Continued)

(58) Field of Classification Search
CPC ..... E02F 9/22; E02F 9/2203; E02F 9/2228; E02F 9/2012; E02F 9/2235; E02F 9/2296
See application file for complete search history.

(56) References Cited

FOREIGN PATENT DOCUMENTS

| | | |
|---|---|---|
| JP | 64-56631 U | 4/1989 |
| JP | 2017-53383 A | 3/2017 |
| JP | 2019-52484 A | 4/2019 |

OTHER PUBLICATIONS

International Search Report (PCT/ISA/210) issued in PCT Application No. PCT/JP2020/006185 dated Apr. 28, 2020 with English translation (six (6) pages).

(Continued)

*Primary Examiner* — Abiy Teka
(74) *Attorney, Agent, or Firm* — Crowell & Moring LLP

(57) ABSTRACT

To make it possible to prevent a decrease in work speed due to a decrease in the speed of a given actuator when an operator unintentionally performs a fine operation of the control lever of the other actuator in a state in which the given actuator is driven by the hydraulic fluid delivered from a plurality of pumps, a controller (41) sets, as a composite dead zone line serving as a boundary of a composite dead zone, a composite dead zone line such that as an operation amount in one direction of a control lever (12L) or (13L) of a control lever device (12) or (13) is increased, the width of the composite dead zone corresponding to an operation amount in the other direction of the control lever is widened, and corrects the operation amount in the other direction such that the demanded flow rate of an actuator increases from zero, when the control lever is operated in the other direction in a state in which the operation amount in the one direction of the control lever remains within a range of the composite dead zone, and the operation amount in the other direction exceeds the composite dead zone line.

5 Claims, 14 Drawing Sheets

(51) Int. Cl.
*F15B 11/17* (2006.01)
*F15B 19/00* (2006.01)

(52) U.S. Cl.
CPC ..... *E02F 9/2235* (2013.01); *E02F 9/2267* (2013.01); *E02F 9/2271* (2013.01); *E02F 9/2289* (2013.01); *E02F 9/2292* (2013.01); *E02F 9/2296* (2013.01); *F15B 11/17* (2013.01); *F15B 19/002* (2013.01); *F15B 2211/20576* (2013.01); *F15B 2211/265* (2013.01)

(56) References Cited

OTHER PUBLICATIONS

Japanese-language Written Opinion (PCT/ISA/237) issued in PCT Application No. PCT/JP2020/006185 dated Apr. 28, 2020 (four (4) pages).
International Preliminary Report on Patentability (PCT/IB/338 & PCT/IB/373) issued in PCT Application No. PCT/JP2020/006185 dated Sep. 16, 2021, including English translation of document C2 (Japanese-language Written Opinion (PCT/ISA/237), filed Mar. 16, 2021) (seven (7) pages).

FIG. 6

| | BOOM | ARM | BUCKET | SWING |
|---|---|---|---|---|
| PUMP P1 | 1 | 2 | 3 | 4 |
| PUMP P2 | 2 | 3 | 4 | 1 |
| PUMP P3 | 3 | 4 | 1 | 2 |
| PUMP P4 | 4 | 1 | 2 | 3 |

PT

SWING

PRESENT INVENTION

SWING

COMPARATIVE EXAMPLE

CONSTRUCTION MACHINE

TECHNICAL FIELD

The present invention relates to a construction machine having a plurality of actuators connected in closed circuits to a plurality of closed circuit pumps.

BACKGROUND ART

Recently, energy savings in construction machines have been desired from an increase in environmental awareness and the like. In a construction machine such as a hydraulic excavator, a wheel loader, or the like, energy savings in a hydraulic system for driving the machine are important, and various hydraulic systems have been proposed thus far.

Consideration has been given to the application of, as an energy saving system applicable to a hydraulic excavator, a hydraulic system in which closed circuit connection is established between a hydraulic pump and a hydraulic actuator without the intervention of a throttle valve and the hydraulic actuator is directly driven by a hydraulic fluid delivered by the hydraulic pump. This hydraulic system is free from a throttle loss because the pump delivers only a flow rate of hydraulic fluid necessitated by the actuator.

There is Patent Document 1 that discloses a construction machine having such a hydraulic system. The hydraulic system described in Patent Document 1 includes: a plurality of actuators connected in closed circuits to a plurality of closed circuit pumps; and a plurality of selector valves that are respectively arranged between the plurality of closed circuit pumps and the plurality of actuators, and switch interruption and communication of the respective closed circuits between the plurality of closed circuit pumps and the plurality of actuators.

PRIOR ART DOCUMENT

Patent Document

Patent Document 1: JP-2017-53383-A

SUMMARY OF THE INVENTION

Problem to be Solved by the Invention

In the hydraulic system described in Patent Document 1, when a fine operation of the control lever of another actuator (second actuator) is performed in a state in which a given actuator (first actuator) is driven by a hydraulic fluid delivered from two pumps (a first pump and a second pump), one of the two pumps connected to the first actuator is reconnected to the second actuator by opening and closing control of selector valves in order to ensure operability of the second actuator.

Hence, the pump is reconnected even if the fine operation of the control lever of the second actuator is unintentionally and erroneously performed by an operator. In this case, the pumps used by the first actuator are decreased, and thus the speed of the first actuator is decreased significantly, work speed is decreased, and workability is impaired.

The present invention has been made in view of an actual situation as described above. It is an object of the present invention to provide a construction machine that can prevent a decrease in the speed of a given actuator and a decrease in work speed when an operator unintentionally performs a fine operation of a control lever of another actuator in a state in which the given actuator is driven by a hydraulic fluid delivered from a plurality of pumps.

Means for Solving the Problem

In order to achieve this object, according to the present invention, there is provided a construction machine comprising: a plurality of closed circuit pumps; a plurality of regulators that adjusts displacements of the plurality of closed circuit pumps; a plurality of actuators connected in closed circuits to the plurality of closed circuit pumps; a plurality of selector valves that are respectively arranged between the plurality of closed circuit pumps and the plurality of actuators, and switches interruption and communication of the respective closed circuits between the plurality of closed circuit pumps and the plurality of actuators; a plurality of operation devices that generate instructions for operation of the plurality of actuators; and a controller that receives operation signals from the plurality of operation devices, calculates demanded flow rates of the plurality of actuators on a basis of respective operation amounts of the plurality of operation devices calculated from the operation signals and a plurality of demanded flow rate characteristics set in advance, and controls the plurality of selector valves and the plurality of regulators according to the demanded flow rates, wherein the plurality of operation devices include a control lever device that enables generation of instructions for operation of two actuators by one control lever, the control lever device is configured to generate an instruction for operation of one of the two actuators when the control lever is operated in a first direction, and generate an instruction for operation of other one of the two actuators when the control lever is operated in a second direction orthogonal to the first direction, and the controller is configured to, in case where an operation component in the other direction is contained when the control lever is operated in one of the first and second directions, generate a composite dead zone in which the one actuator is operated by the operation of the control lever in the one direction and an operation of the other actuator is disabled by the operation of the control lever in the other direction, on a basis of the demanded flow rate characteristics corresponding to the two actuators among the plurality of demanded flow rate characteristics, and when the control lever is operated in the first and second directions beyond the composite dead zone, generate a composite operation region in which the two actuators are operated on the basis of the demanded flow rate characteristics corresponding to the two actuators, and wherein the controller is further configured to set a composite dead zone line as a boundary between the composite dead zone and the composite operation region such that a width of the composite dead zone corresponding to an operation amount in the other direction of the control lever of the control lever device is widened as an operation amount in the one direction of the control lever is increased, and correct the operation amount in the other direction such that the demanded flow rate of the actuator driven by the operation in the other direction increases from zero, when the control lever is operated in the other direction in a state in which the operation amount in the one direction of the control lever remains within a range of the composite dead zone, and the operation amount in the other direction exceeds the composite dead zone line.

In this way, by configurating the controller to set a composite dead zone line as a boundary between the composite dead zone and the composite operation region such that a width of the composite dead zone corresponding to an operation amount in the other direction of the control lever of the control lever device is widened as an operation amount in the one direction of the control lever is increased, pump connection can be prevented from switching from a given actuator to another actuator when an operator unintentionally performs a fine operation of the control lever of the other actuator in a state in which the given actuator is driven by a hydraulic fluid delivered from a plurality of pumps, and a decrease in work speed due to a decrease in actuator speed can be prevented.

In addition, by configurating the controller to correct the operation amount in the other direction such that the demanded flow rate of the actuator driven by the operation in the other direction increases from zero, when the control lever is operated in the other direction in a state in which the operation amount in the one direction of the control lever remains within a range of the composite dead zone, and the operation amount in the other direction exceeds the composite dead zone line, when the control lever is operated in the other direction, and the operation amount in the other direction exceeds the composite dead zone line, the actuator driven by the operation in the other direction starts to operate smoothly. Consequently, a rise in actuator speed when the operation amount of the control lever of a given actuator enters the composite operation region from the composite dead zone and thus a composite operation is started can be prevented from becoming sharp.

Advantages of the Invention

According to the present invention, pump connection can be prevented from switching from a given actuator to another actuator when an operator unintentionally performs a fine operation of the control lever of the other actuator in a state in which the given actuator is driven by a hydraulic fluid delivered from a plurality of pumps, and a decrease in work speed due to a decrease in actuator speed can be prevented.

In addition, according to the present invention, a rise in actuator speed when the operation amount of the control lever of a given actuator enters the composite operation region from the composite dead zone and thus a composite operation is started can be prevented from becoming sharp.

BRIEF DESCRIPTION OF THE DRAWINGS

FIG. 6 is a diagram showing an example of a table (priority table) defining the priority order of connection relation between closed circuit pumps and the actuators, the table being used for valve switching control and pump delivery flow rate control.

MODES FOR CARRYING OUT THE INVENTION

Embodiments of the present invention will be described with reference to the drawings.

First Embodiment

~Configuration~

Figure 1:
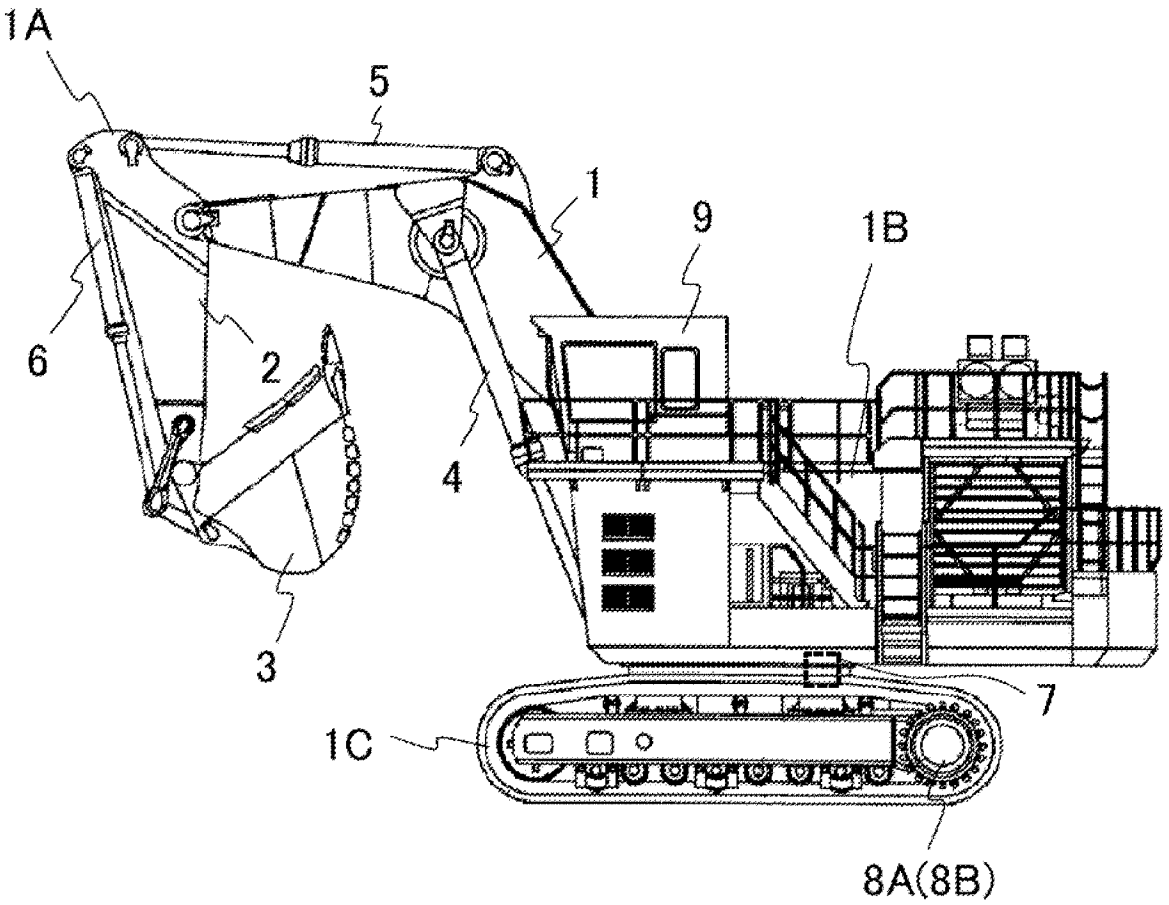
FIG. 1 is a side view of a hydraulic excavator as a construction machine in one embodiment of the present invention.

FIG. 1 is a side view of a hydraulic excavator as a construction machine in one embodiment of the present invention.

In FIG. 1, the hydraulic excavator includes a front implement 1A, an upper swing structure 1B, and a lower track structure 1C. The front implement 1A includes a boom 1, an arm 2, and a bucket 3. In addition, the hydraulic excavator includes a boom cylinder 4 for operating the boom 1, an arm cylinder 5 for operating the arm 2, a bucket cylinder 6 for operating the bucket 3, a swing motor 7 for swinging the upper swing structure 1B, and a left and a right travelling motor 8A and 8B for making the lower track structure 1C travel.

Figure 2:
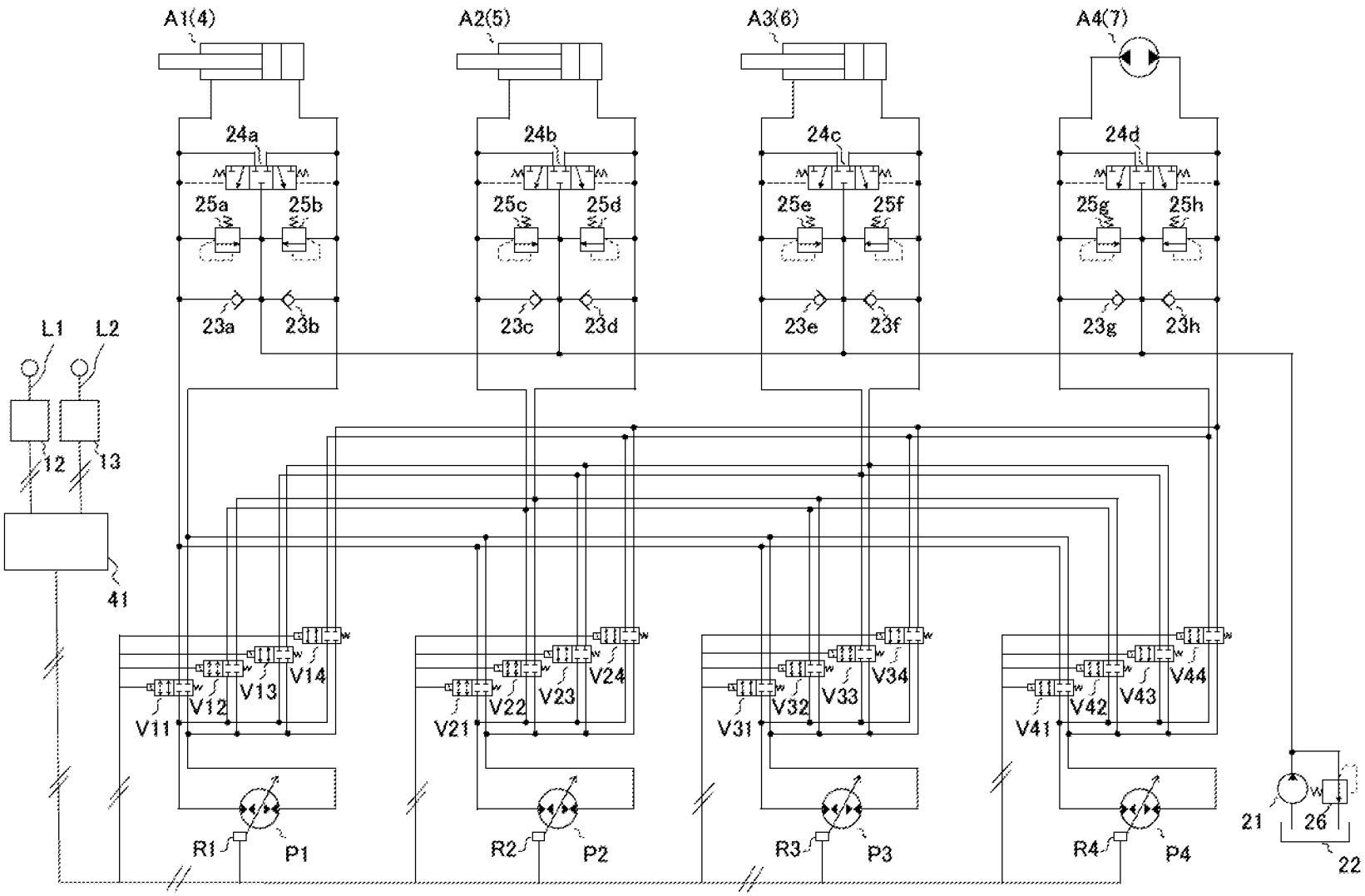
FIG. 2 is a diagram showing a circuit configuration of a hydraulic system provided to the hydraulic excavator shown in FIG. 1.

FIG. 2 is a diagram showing a circuit configuration of a hydraulic system provided to the hydraulic excavator shown in FIG. 1.

In FIG. 2, the hydraulic system includes: a plurality of closed circuit pumps P1 to P4; a plurality of hydraulic actuators A1 to A4 connected in closed circuits to the plurality of closed circuit pumps P1 to P4; a plurality of selector valves V11 to V14, V21 to V24, V31 to V34, and V41 to V44 that are respectively arranged between the plurality of closed circuit pumps P1 to P4 and the plurality of hydraulic actuators A1 to A4, and switch interruption and communication of the respective closed circuits between the plurality of closed circuit pumps P1 to P4 and the plurality of hydraulic actuators A1 to A4; and a plurality of operation devices 12 and 13 that generate instructions for operation of the plurality of hydraulic actuators A1 to A4.

The closed circuit pumps P1 to P4 are each a variable displacement hydraulic pump that is of a bidirectionally tiltable type and has two delivery ports. The closed circuit pumps P1 to P4 are driven by a prime mover (for example, a diesel engine) not shown. In addition, the closed circuit pumps P1 to P4 respectively have regulators R1 to R4 for adjusting pump displacements of the closed circuit pumps P1 to P4. The delivery rates of the closed circuit pumps P1 to P4 are controlled by adjusting the respective pump displacements. The closed circuit pumps P1 to P4 are pumps whose maximum delivery rates are all equal to each other.

In addition, the hydraulic system has a charge pump 21 as a unidirectionally tilting fixed displacement pump. The closed circuit pumps P1 to P4 and the charge pump 21 are driven by the prime mover not shown.

The closed circuit pump P1 is connected so as to draw in a hydraulic fluid from one of two ports of the hydraulic actuators A1 to A4 and deliver the hydraulic fluid to the other port via the selector valves V11 to V14. The closed circuit pump P1 forms a closed circuit with each of the hydraulic actuators A1 to A4. The closed circuit pump P2 is connected so as to draw in the hydraulic fluid from one of two ports of the hydraulic actuators A1 to A4 and deliver the hydraulic fluid to the other port via the selector valves V21 to V24. The closed circuit pump P2 forms a closed circuit with each of the hydraulic actuators A1 to A4. The closed circuit pump P3 is connected so as to draw in the hydraulic fluid from one of two ports of the hydraulic actuators A1 to A4 and deliver the hydraulic fluid to the other port via the selector valves V31 to V34. The closed circuit pump P3 forms a closed circuit with each of the hydraulic actuators A1 to A4. The closed circuit pump P4 is connected so as to draw in the hydraulic fluid from one of two ports of the hydraulic actuators A1 to A4 and deliver the hydraulic fluid to the other port via the selector valves V41 to V44. The closed circuit pump P4 forms a closed circuit with each of the hydraulic actuators A1 to A4.

The hydraulic actuator A1 is, for example, the boom cylinder 4 shown in FIG. 1. The hydraulic actuator A2 is, for example, the arm cylinder 5 shown in FIG. 1. The hydraulic actuator A3 is, for example, the bucket cylinder 6 shown in FIG. 1. The hydraulic actuator A4 is, for example, the swing motor 7 shown in FIG. 1.

The charge pump 21 draws in the hydraulic fluid from a tank 22, and replenishes each closed circuit with the hydraulic fluid via a charge hydraulic line 27 and makeup valves 23*a* to 23*h*. Flushing valves 24*a* to 24*d* discharge excess hydraulic fluids of the closed circuits (for example, excess hydraulic fluids of the closed circuits which occur due to pressure receiving area differences between cap chambers and rod chambers of the hydraulic cylinders A1 to A3) to the tank 22 via the charge hydraulic line 27. Main relief valves 25*a* to 25*h* set maximum pressures in the respective closed circuits. A charge relief valve 26 sets a maximum pressure in the charge hydraulic line 27.

The regulators R1 to R4 and the selector valves V11 to V14, V21 to V24, V31 to V34, and V41 to V44 are electrically connected to a controller 41. The regulators R1 to R4 and the selector valves V11 to V14, V21 to V24, V31 to V34, and V41 to V44 are operated by command signals from the controller 41 to adjust the pump displacements and switch interruption and communication of the closed circuits.

In addition, the operation devices 12 and 13 are operation devices of a control lever type. The operation devices 12 and 13 are electrically connected to the controller 41. Operation signals are input from the operation devices 12 and 13 to the controller 41.

In the hydraulic circuit of FIG. 2, only parts related to the boom cylinder 4, the arm cylinder 5, the bucket cylinder 6, and the swing motor 7 are shown, and parts related to the left and right travelling motors 8A and 8B are not shown. In addition, of operation devices giving instructions for operation of actuators, only the operation devices 12 and 13 for the boom cylinder 4, the arm cylinder 5, the bucket cylinder 6, and the swing motor 7 are shown, and the operation devices for the left and right travelling motors 8A and 8B are not shown. In the following description, when the operation devices for all of the actuators are referred to collectively, the operation devices will be referred to simply as operation devices, and the operation devices 12 and 13 for the boom cylinder 4, the arm cylinder 5, the bucket cylinder 6, and the swing motor 7 will be referred to as control lever devices.

Figure 3:
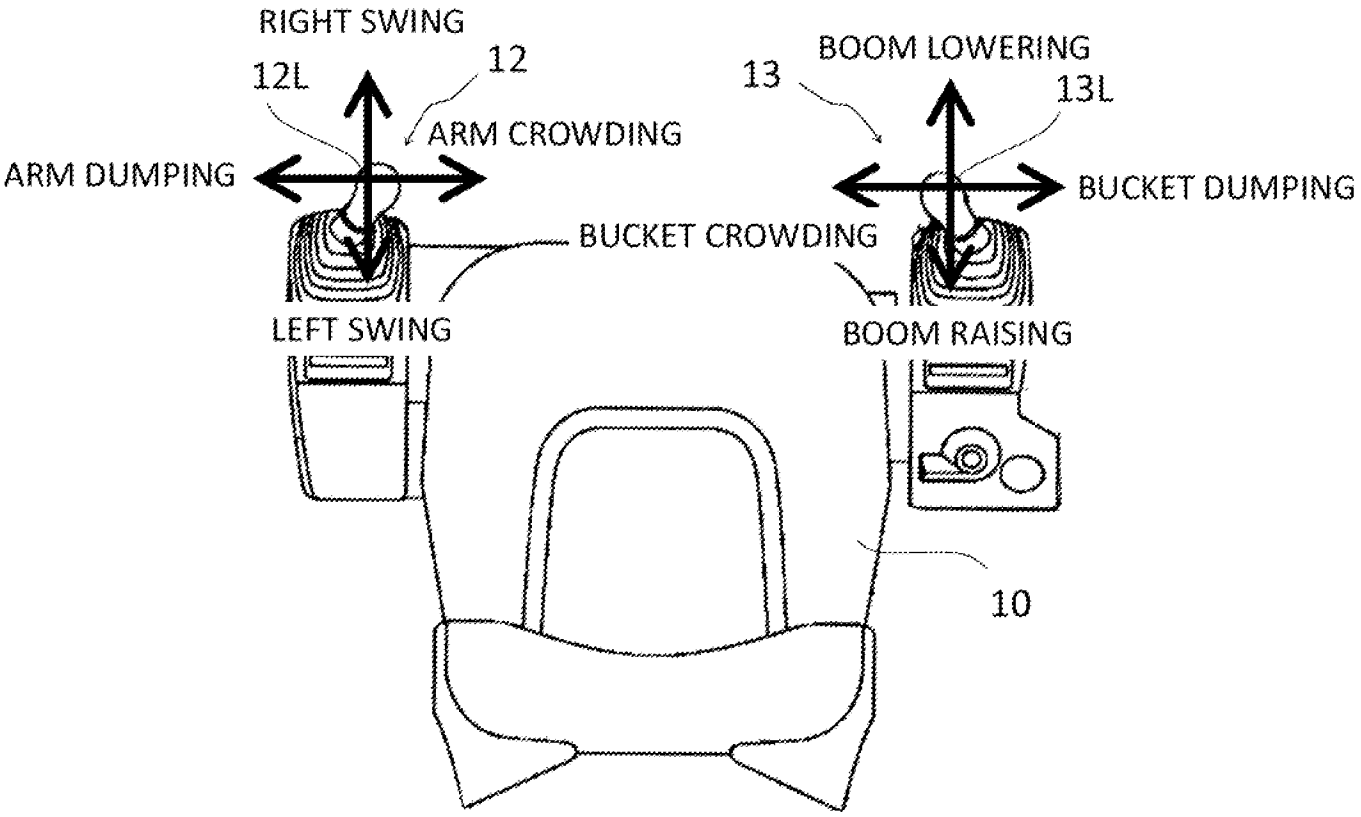
FIG. 3 is a diagram showing an arrangement and operation modes of control lever devices.

FIG. 3 is a diagram showing an arrangement and operation modes of the control lever devices 12 and 13. The control lever devices 12 and 13 are installed on a left and a right of a front portion of a cab seat 10 within a cab (cabin) 9 of the hydraulic excavator shown in FIG. 1. The control lever devices 12 and 13 respectively have a left and a right control lever 12L and 13L. An operator operates the left control lever 12L with a left hand, and operates the right control lever 13L with a right hand. The control lever devices 12 and 13 are each a control lever device that can generate instructions for operation of two actuators by one control lever 12L or 13L. Operations in a left-right direction of the control lever 12L correspond to operation instructions for the arm cylinder 5. Operations in an upward-downward direction of the control lever 12L correspond to operation instructions for the swing motor 7. Operations in the left-right direction of the control lever 13L correspond to operation instructions for the bucket cylinder 6. Operations in the upward-downward direction of the control lever 13L correspond to operation instructions for the boom cylinder 4. Thus, the control lever device 12 generates an instruction for operation of one of the two actuators (arm cylinder 5) when the control lever 12L is operated in the left-right direction (first direction), and the control lever device 12 generates an instruction for operation of the other of the two actuators (swing motor 7) when the control lever 12L is operated in the upward-downward direction (second direction orthogonal to the first direction). Similarly, the control lever device 13 generates an instruction for operation of one of the two actuators (bucket cylinder 6) when the control lever 13L is operated in the left-right direction (first direction), and the control lever device 13 generates an instruction for operation of the other of the two actuators (boom cylinder 4) when the control lever 13L is operated in the upward-downward direction (second direction orthogonal to the first direction).

The controller 41 receives operation signals from a plurality of operation devices (control lever devices 21 and 22), calculates the demanded flow rates of the plurality of actuators 4 to 7 on the basis of respective operation amounts of the plurality of operation devices calculated from the operation signals and a plurality of demanded flow rate characteristics (to be described later) set in advance, and controls the plurality of selector valves V11 to V14, V21 to V24, V31 to V34, and V41 to V44 according to the demanded flow rates.

Figure 4:
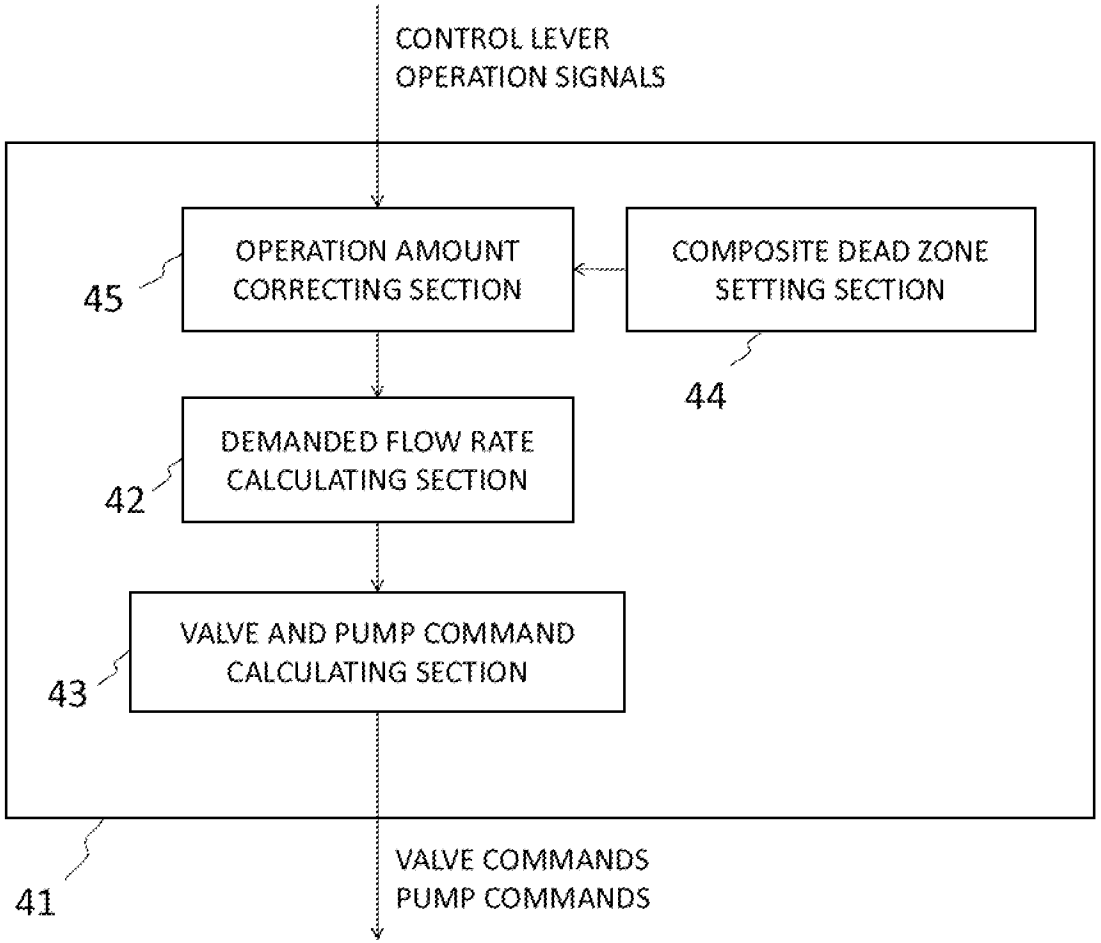
FIG. 4 is a functional block diagram showing processing functions of a controller.

FIG. 4 is a functional block diagram showing processing functions of the controller 41.

The controller 41 includes a demanded flow rate calculating section 42, a valve and pump command calculating section 43, a composite dead zone setting section 44, and an operation amount correcting section 45.

The demanded flow rate calculating section 42 and the valve and pump command calculating section 43 will first be described.

The controller 41 is supplied with the operation signals of the control lever devices 12 and 13, calculates operation amounts of the control levers 12L and 13L from the operation signals, and thereby obtains information about the lever operation amounts. The lever operation amounts are corrected in the operation amount correcting section 45. The corrected operation amounts are input to the demanded flow rate calculating section 42.

Figure 5:
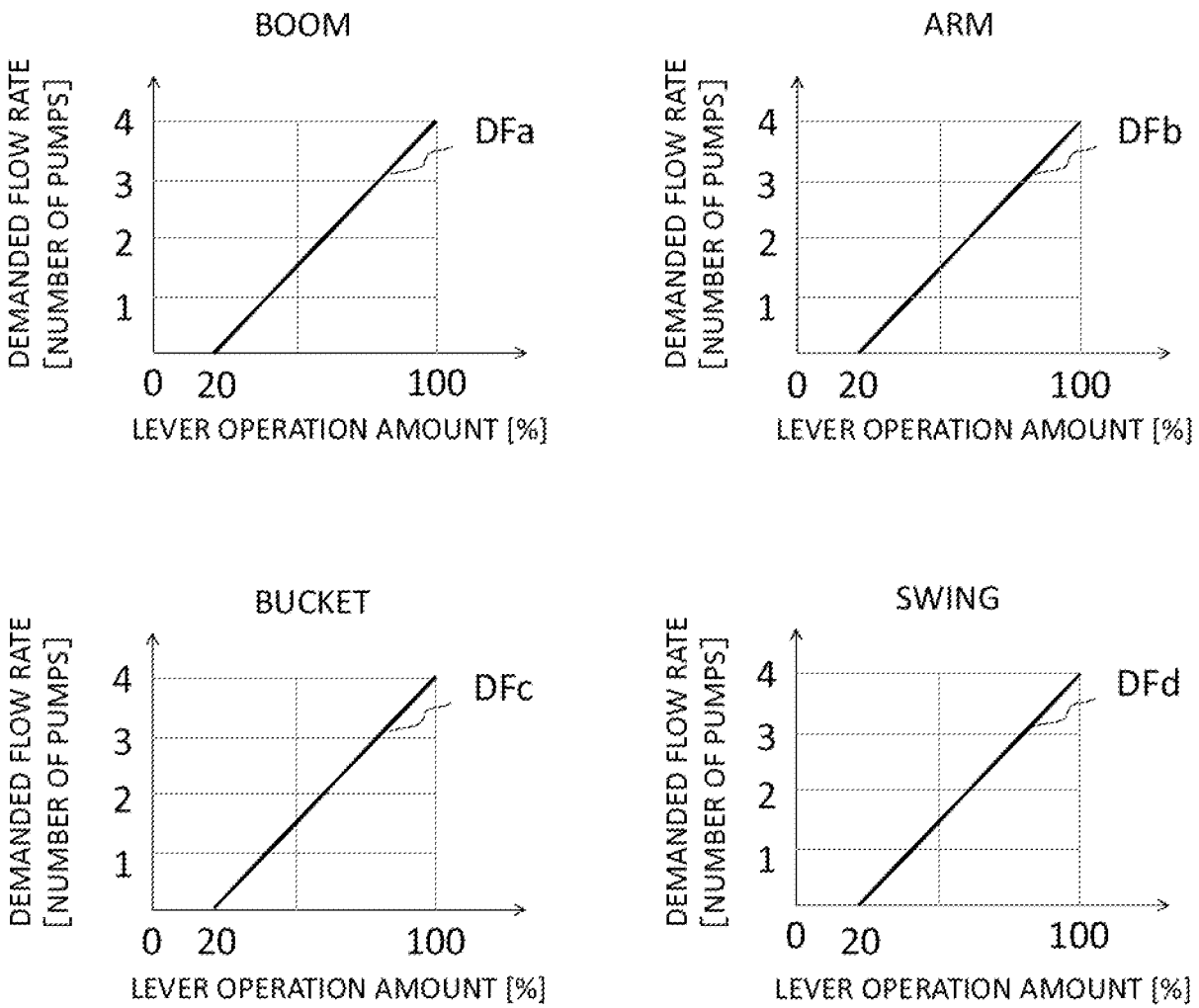
FIG. 5 is a diagram showing an example of demanded flow rate characteristics of actuators (a boom cylinder, an arm cylinder, a bucket cylinder, and a swing motor) with respect to operation amounts of a left and a right control lever (lever operation amounts), the demanded flow rate characteristics being for use in calculating demanded flow rates.

The demanded flow rate calculating section 42 calculates the respective demanded flow rates of the boom cylinder 4, the arm cylinder 5, the bucket cylinder 6, and the swing motor 7 according to the lever operation amounts corrected in the operation amount correcting section 45. FIG. 5 is a diagram showing an example of the demanded flow rate characteristics of the actuators (the boom cylinder 4, the arm cylinder 5, the bucket cylinder 6, and the swing motor 7) with respect to the operation amounts of the control levers 12L and 13L (lever operation amounts), the demanded flow rate characteristics being for use in calculating the demanded flow rates. Here, the controller of a conventional hydraulic excavator does not include the composite dead zone setting section 44 nor the operation amount correcting section 45, but includes only the demanded flow rate calculating section 42 and the valve and pump command calculating section 43. In that case, the lever operation amounts obtained from the operation signals of the control lever devices 12 and 13 are directly input to the demanded flow rate calculating section 42.

A demanded flow rate characteristic DFa of the boom cylinder 4, a demanded flow rate characteristic DFb of the arm cylinder 5, a demanded flow rate characteristic DFc of the bucket cylinder 6, and a demanded flow rate characteristic DFd of the swing motor 7 as shown in FIG. 5 are set in the demanded flow rate calculating section 42. The demanded flow rate characteristics DFa to DFb are each set such that, for example, there is a dead zone and the demanded flow rate is zero between lever operation amounts 0 to 20%, and the demanded flow rate increases linearly as the lever operation amount increases from 20% to 100%. Incidentally, while it is assumed in FIG. 5 that the demanded flow rate characteristics of all of the actuators are the same, and demanded flow rate characteristics in operations in opposite directions of the same actuators of the control levers 12L and 13L are the same, these characteristics may be different.

The valve and pump command calculating section 43 performs ON/OFF (opening and closing) valve switching control of the selector valves V11 to V14, V21 to V24, V31 to V34, and V41 to V44 and delivery flow rate control of the closed circuit pumps P1 to P4 by the regulators R1 to R4 on the basis of the demanded flow rates calculated by the demanded flow rate calculating section 42. FIG. 6 is a diagram showing an example of a table (hereinafter referred to as a priority table) PT defining the priority order of connection relation between the closed circuit pumps P1 to P4 and the actuators 4 to 7, the table being used for the valve switching control and the pump delivery flow rate control. Numerical values in a vertical column represent the priority order of pump connections as viewed from the actuators. Numerical values in a horizontal row represent the priority order of actuator connections as viewed from a pump side.

The valve and pump command calculating section 43 performs pump allocation calculation processing that determines to which actuators to connect the closed circuit pumps P1 to P4 by using the priority table PT shown in FIG. 6 according to the demanded flow rates calculated by the demanded flow rate calculating section 42, generates valve command signals that perform ON/OFF (opening and closing) switching control of the selector valves V11 to V14, V21 to V24, V31 to V34, and V41 to V44 and pump command signals that perform control of the delivery flow rates of the closed circuit pumps P1 to P4 according to a calculation result of the pump allocation calculation processing, and outputs the valve command signals to the selector valves V11 to V14, V21 to V24, V31 to V34, and V41 to V44 and outputs the pump command signals to the regulators R1 to R4.

Further details of processing contents of the demanded flow rate calculating section 42 and the valve and pump command calculating section 43 will be described in the following by using an operation example of the hydraulic excavator. It is considered in this operation example that 100% is input as an operation amount of bucket dumping of the left control lever 13L.

First, the demanded flow rate calculating section 42 calculates the demanded flow rates of the actuators 4 to 7 which correspond to the operation amounts of the control levers 12L and 13L by using the demanded flow rate characteristics DFa to DFd shown in FIG. 5. In the present operation example, the operation amount of bucket dumping is 100%. Thus, the demanded flow rate of bucket dumping is determined as 4.0 from the characteristic DFc. Here, a demanded flow rate of 4.0 means demanding the pump flow rates of four pumps (flow rates of the pumps P1 to P4) at a maximum delivery flow rate.

When the demanded flow rates of the boom, the arm, the bucket, and a swing are thus determined as 0, 0, 4.0, 0, respectively, the processing next proceeds to the processing of the valve and pump command calculating section 43. The valve and pump command calculating section 43 allocates the pumps P1 to P4 to the actuators 4 to 7 according to the demanded flow rates as a calculation result of the demanded flow rate calculating section 42 and the priority connection order of the pumps and the actuators in the priority table PT shown in FIG. 6.

Figure 7:
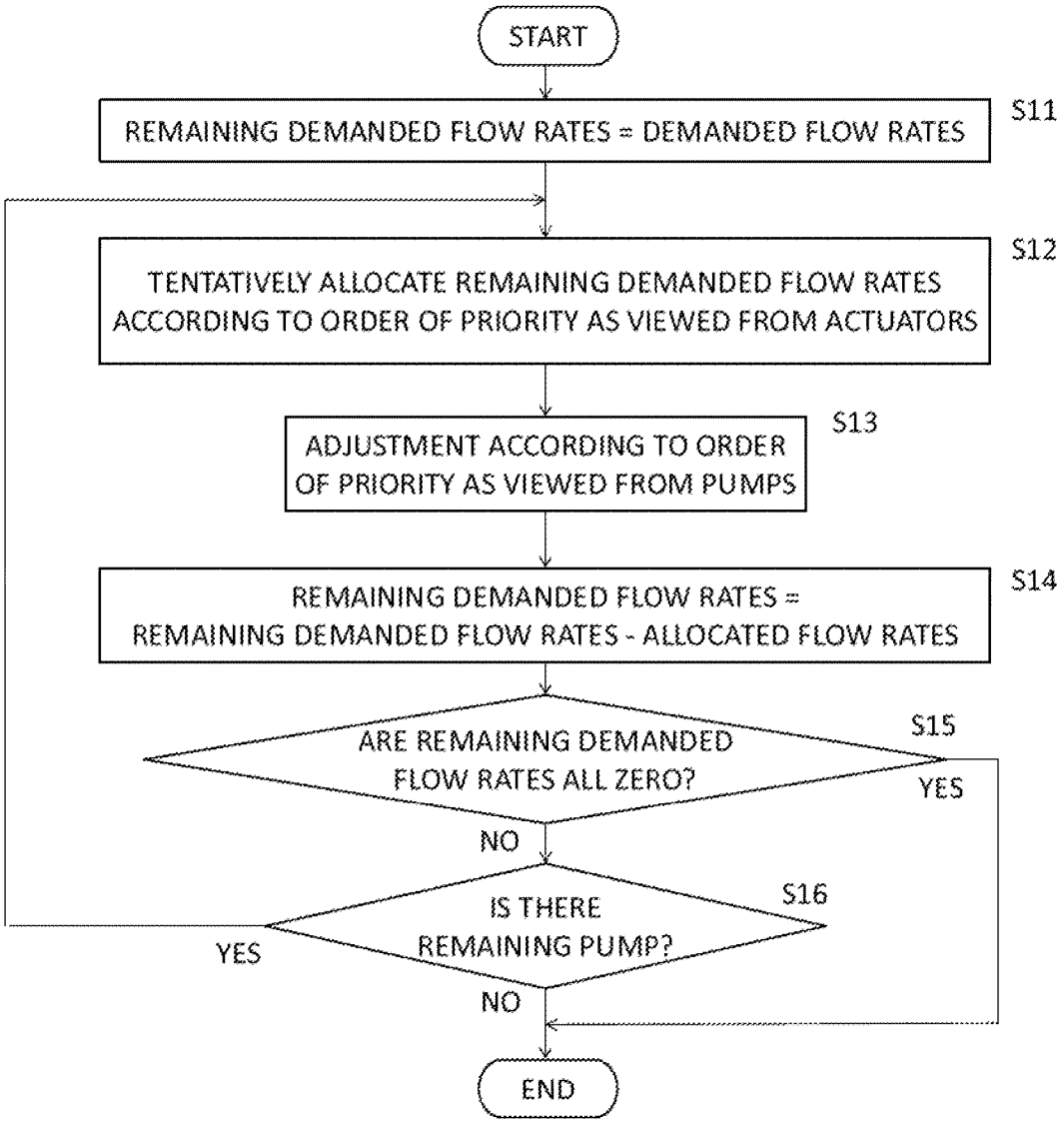
FIG. 7 is a flowchart showing pump allocation calculation processing in one control cycle of a valve and pump command calculating section.

FIG. 7 is a flowchart showing the pump allocation calculation processing in one control cycle of the valve and pump command calculating section 43.

First, the valve and pump command calculating section 43 in step F11 substitutes present demanded flow rates for remaining demanded flow rates. In the present operation example, (boom, arm, bucket, swing)=(0, 0, 4.0, 0). Thus, the remaining demanded flow rates in step F11 are (0, 0, 4.0, 0). In next step F12, the remaining demanded flow rates calculated in step F11 are tentatively allocated according to the priority order as viewed from the actuators 4 to 7 side by using the priority table PT. In the present operation example, the remaining demanded flow rate of the bucket cylinder 6 is 4.0. Thus, according to the priority order of the priority table PT, the pump P3 (ranking 1) is tentatively allocated at a flow rate of 1.0 to the bucket cylinder 6, the pump P4 (ranking 2) is tentatively allocated at a flow rate of 1.0 to the bucket cylinder 6, the pump P1 (ranking 1) is tentatively allocated at a flow rate of 1.0 to the bucket cylinder 6, and the pump P2 (ranking 4) is tentatively allocated at a flow rate of 1.0 to the bucket cylinder 6. In next step F13, allocation adjustment of the tentative allocation calculated in step F12 is made according to the priority order as viewed from the pumps P1 to P4 side in the priority order of the priority table PT. That is, when there are a plurality of actuators connected as viewed from the side of a pump P1 to P4, processing is performed which connects the pump to only an actuator of higher priority (smaller number). In the present operation example, all of the pumps P1 to P4 are connected only to the bucket cylinder 6. Thus, no adjustment is made, and the processing proceeds to next step F14. In step F14, differences between the remaining demanded flow rates and the flow rates allocated in the processing thus far are calculated, and substituted for the remaining demanded flow rates. In the present operation example, the allocated flow rates are (0, 0, 4.0, 0). Thus, the differences between the remaining demanded flow rate and the allocated flow rates are (0, 0, 4.0, 0)−(0, 0, 4.0, 0)=(0, 0, 0, 0), and the remaining demanded flow rates after the substitution are (0, 0, 0, 0). Next step F15 determines whether or not the remaining demanded flow rates are all zero. When the remaining demanded flow rates are all zero, the allocation calculation processing is ended. When the remaining demanded flow rates are not all zero, the processing proceeds to step F16. Step F16 determines whether or not there is a remaining pump. When there is still a remaining pump, the processing returns to step F12. When there is no remaining pump, the allocation calculation processing is ended. In the present operation example, the remaining demanded flow rates in step F14 are (0, 0, 0, 0), that is, all zero. Thus, the processing in this control cycle is ended according to step F15.

As a result of the processing as described above, all of the pumps P1 to P4 are allocated at a flow rate of 1.0 to the bucket cylinder 6. Hence, the controller 41 outputs open valve commands to the valves V13, V23, V33, and V43, and does not output open valve commands to the other valves. In addition, a command of a flow rate of 1.0 is issued to all of the regulators R1, R2, R3, and R4 of the pumps P1, P2, P3, and P4. Consequently, the bucket cylinder 6 is supplied with the flow rate of the hydraulic fluid which corresponds to the lever operation amount, and the bucket cylinder 6 is driven at a speed corresponding to the lever operation amount.

The composite dead zone setting section 44 and the operation amount correcting section 45 shown in FIG. 4 will next be described.

In the present embodiment, the lever operation amounts based on the operation signals from the control lever devices 12 and 13 which are input to the controller 41 are not directly input to the demanded flow rate calculating section 42, but are corrected in the operation amount correcting section 45 by using composite dead zone lines set in the composite dead zone setting section 44, and the corrected lever operation amounts are input to the demanded flow rate calculating section 42.

Description will first be made of a necessity of correcting the lever operation amounts obtained on the basis of the operation signals from the control lever devices 12 and 13.

Figure 8:
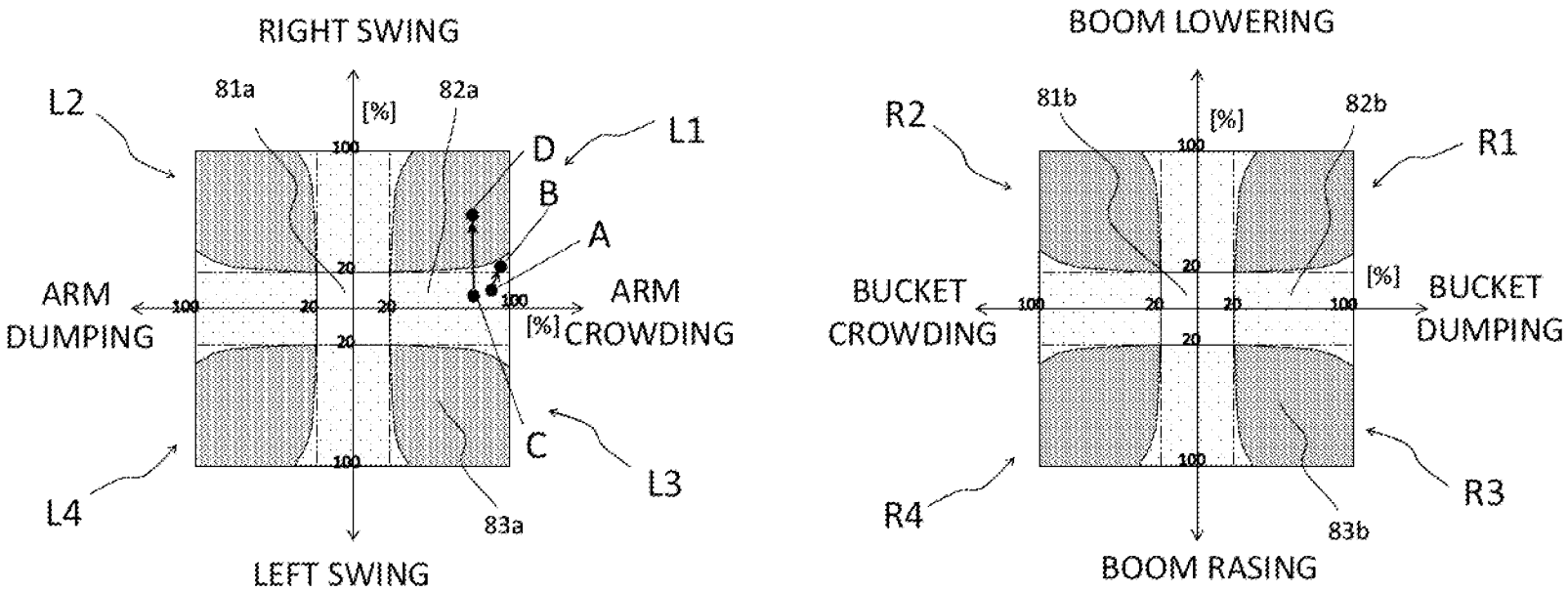
FIG. 8 is a diagram showing relation between the operation amounts (positions) of control levers 12L and 13L and the operation of actuators 4 to 7, where an operation amount correcting section 45 corrects the operation amounts of the control levers 12L and 13L, and is a diagram in which chain double-dashed lines represent composite dead zone lines, where the operation amount correcting section 45 does not correct the operation amounts of the control levers 12L and 13L.

FIG. 8 is a diagram showing relation between the operation amounts (positions) of the control levers 12L and 13L and the operation of the actuators 4 to 7, where the operation amount correcting section 45 corrects the operation amounts of the control levers 12L and 13L. In addition, in FIG. 8, chain double-dashed lines represent the composite dead zone lines, where the operation amount correcting section 45 does not correct the operation amounts of the control levers 12L and 13L.

A left diagram and a right diagram of FIG. 8 show relations between the respective operation amounts (positions) of the right control lever 13L and the left control lever 12L and the operation of the actuators 4 to 7. Four operation quadrants L1, L2, L3, and L4 are generated by the left control lever 12L. Four operation quadrants R1, R2, R3, and R4 are generated by the right control lever 13L. The operation quadrant R1 is an operation region of arm crowding and right swing. The operation quadrant R2 is an operation region of arm dumping and right swing. The operation quadrant R3 is an operation region of arm crowding and left swing. The operation quadrant R4 is an operation region of arm dumping and left swing. In addition, rectangular regions 81*a* and 81*b* shown in white in the figure represent regions in which neither of the two actuators operates (which will hereinafter be referred to as neutral dead zones as appropriate). Regions 82*a* and 82*b* indicated by dots represent regions in which one of the actuators operates (which will hereinafter be referred to as composite dead zones as appropriate). Regions 83*a* and 83*b* indicated by hatching represent regions in which both of the two actuators operate (which will hereinafter be referred to as composite operation regions as appropriate).

The demanded flow rate characteristics of the respective actuators are set in the demanded flow rate calculating section 42. In each of the operation quadrants L1 to L4 and R1 to R4 of the left and right control levers 12L and 13L, the controller 41 is configured to generate the composite dead zones 82*a* and 82*b* in which one actuator is operated by an operation in one direction and the operation of the other actuator is disabled by the operation in the other direction on the basis of the demanded flow rate characteristics, when the control lever 12L or 13L is operated in the one direction of the left-right direction (first direction) and the upward-downward direction (second direction) and an operation component in another direction is contained, and generate the composite operation regions 83*a* and 83*b* in which the two actuators are operated on the basis of the demanded flow rate characteristics when the control lever 12L and 13L are operated in the left-right direction (first direction) and the upward-downward direction (second direction) beyond the composite dead zone 82*a* or 82*b*.

Now, it is considered, as shown in FIG. 8, that the operation amount of the left control lever 12L is at the position of point A within the composite dead zone 82*a* (the operation amount of arm crowding is 90%, and the operation amount of right swing is 10%). For the operation amount at this point A, valve and pump commands are calculated according to FIGS. 5 to 7. First, on the basis of the demanded flow rate characteristics DFb and DFd in FIG. 5, the demanded flow rate of the arm crowding operation is calculated to be $\{4/(100-20)\}\times(90-20)=3.5$, and the demanded flow rate of the right swing operation is calculated to be 0. In the present embodiment, a threshold value of the neutral dead zone 81*a* is set at 20%, and the operation amount of 10% of the right swing does not exceed a dead zone of 20%. Thus, the demanded flow rate of the right swing operation is calculated to be 0. For this demanded flow rate, valve and pump commands are calculated according to the connection relation priority order set in the priority table PT of FIG. 6. Processing similar to that described above generates a command of a flow rate of 1.0 for the pump P1, a command of a flow rate of 1.0 for the pump P2, a command of a flow rate of 0.5 for the pump P3, and a command of a flow rate of 1.0 for the pump P4, and outputs open valve commands to the valve V12, the valve V22, the valve V32, and the valve V42. Consequently, the four pumps (all pumps) P1 to P4 are connected to the arm cylinder 5, and the arm cylinder 5 is driven at a speed of a flow rate of 3.5 in a crowding direction.

Consideration will be given to a case where the arm crowding operation is further increased in a state in which the hydraulic excavator is thus driven. It is considered, in this case, that a right swing is erroneously input so as to drag in the control lever 12L, and that the operation amount at point A is moved to point B (the operation amount of the arm crowding is 100%, and the operation amount of the right swing is 22%) within the composite operation region 83*a*. For the operation amount at this point B, when the operation amount correcting section 45 does not correct the operation amounts of the control levers 12L and 13L, the demanded flow rate of the arm crowding operation is calculated to be 4.0, and the demanded flow rate of the right swing operation is calculated to be $\{4/(100-20)\}\times(22-20)=2/20=0.1$, on the basis of the demanded flow rate characteristics DFb and DFd. The processing of the valve and pump command calculating section 43 is performed for the thus calculated demanded flow rates. Processing similar to that described above generates a command of a flow rate of 1.0 for the pump P1, a command of a flow rate of 0.1 for the pump P2, a command of a flow rate of 1.0 for the pump P3, and a command of a flow rate of 1.0 for the pump P4, and outputs open valve commands to the valve V12, the valve V24, the valve V32, and the valve V42. That is, the pumps P1, P3, and P4 are connected to the arm cylinder 5, and the pump P2 is connected to the swing motor 7. Consequently, the arm cylinder 5 is driven at a speed of a flow rate of 3.0 in the crowding direction, and the swing motor 7 is driven at a speed of a flow rate of 0.1 in a right swing direction.

Hence, when the operation amount correcting section 45 does not correct the operation amounts of the control levers 12L and 13L, the pump P2 connected to the arm cylinder 5 is connected to the swing motor 7 by erroneously increasing the input of the right swing and thereby making the lever operation enter the composite operation region 83*a*. As a result, the speed in the crowding direction of the arm cylinder 5 is decreased from 3.5 to 3.0. In addition, the swing motor 7 is unintentionally driven at the speed of a flow rate of 0.1.

Incidentally, also during actual operation, a case occurs in which when the control lever of a given actuator is thus operated to a large extent, the same control lever is operated in a direction of driving another actuator. This is considered to be caused by the operator focusing attention on the operation of the actuator and being disabled to pay further attention to the operating direction of the other actuator of the control lever when operating the given actuator at high speed.

As described above, when the demanded flow rates are calculated using the lever operation amounts obtained on the basis of the operation signals from the control lever devices 12 and 13 as they are, there is a problem in that work speed is decreased due to a fine operation erroneously performed unintentionally. In addition, there is a problem in that an erroneous operation of an unintended actuator occurs.

The composite dead zone setting section 44 and the operation amount correcting section 45 that solve the above-described problems will next be described.

First, as indicated by a solid line in FIG. 8, in the composite dead zone setting section 44, the controller 41 is further configured to set a composite dead zone line as a boundary between the composite dead zone 82*a* or 82*b* and the composite operation region 83*a* or 83*b* such that, a width of the composite dead zone 82*a* or 82*b* corresponding to an operation amount in the other direction of the control lever 12L or 13L is widened as an operation amount in the one direction of the control lever 12L or 13L of the control lever device 12 or 13 is increased.

In addition, in the operation amount correcting section 45, the controller 41 is further configured to, when the control lever 12L or 13L is operated in the other direction orthogonal to the one direction in a state in which the operation amount in the one direction of the control lever 12L or 13L remains within the range of the composite dead zone 82*a* or 82 and the operation amount in the other direction exceeds the composite dead zone line, correct the operation amount in the other direction such that a ratio of the operation amount in the other direction in a change range of the operation amount in the other direction in a composite operation region E (see FIG. 10; to be described later) corresponds to a ratio of the operation amount in the other direction in a change range of the operation amount in the other direction in a composite operation region in case where composite dead zone lines that make the width of the composite dead zone 82*a* or 82*b* uniform are set, and corrects relation between the operation amount in the other direction and a demanded flow rate characteristic corresponding to an actuator driven by operation in the other direction (corresponding one of the demanded flow rate characteristics DFa to DFd shown in FIG. 5) such that the demanded flow rate of the actuator increases from zero.

In addition, the controller 41 derives a correction equation that, when the control lever 12L or 13L is operated in the other direction to a given position within the composite operation region E (see FIG. 10: to be described later) beyond the composite dead zone line, makes the ratio of the operation amount at the given position within the change range of the operation amount in the other direction in the composite operation region E equal to the ratio of the operation amount at the given position in the given position within the change range of the operation amount in the other direction within the composite operation region in the case where the composite dead zone lines that make the width of the composite dead zone 82*a* or 82*b* uniform are set, and corrects the operation amount in the other direction by using this correction equation, in the operation amount correcting section 45.

In addition, the controller 41 corrects the operation amount in the other direction such that the demanded flow rate of the actuator driven by the operation in the other direction is zero when the control lever 12L or 13L is operated in the other direction in a state in which the operation amount in the one direction of the control lever 12L or 13L remains within the range of the composite dead zone 82*a* or 82*b*, and the operation amount in the other direction reaches the composite dead zone line, and such that the demanded flow rate of the actuator driven by the operation in the other direction increases along the demanded flow rate characteristic corresponding to the actuator (corresponding one of the demanded flow rate characteristics DFa to DFd shown in FIG. 5) as the operation amount increases beyond the composite dead zone line, in the operation amount correcting section 45.

In addition, the controller 41 sets the composite dead zone line, in the operation amount correcting section 45, by using a characteristic line expressed by a function having an order of 3 to 5 and having a coefficient in a range of 0.03 to 0.07.

Details will be described in the following.

In FIG. 4 described above, a single dead zone value and a composite dead zone line in the following, which function at a time of composite operation of actuators sharing the control levers 12L and 13L (the swing motor 7 and the arm cylinder 5 or the boom cylinder 4 and the bucket cylinder 6 in the present embodiment), are set (stored) in the composite dead zone setting section 44.

The single dead zone value: c

The composite dead zone line: $g(x)=f(x-c)+c$

The single dead zone value c is a dead zone value of the control levers 12L and 13L in single operation (in the neutral dead zone).

f(x−c) included in the function representing the composite dead zone line is a function obtained by shifting a characteristic line expressed by f(x) by the single dead zone value c in an x-direction. The characteristic line f(x) is a line determining a boundary between the composite dead zone 82*a* or 82*b* and the composite operation region 83*a* or 83*b*, which is represented by a solid line in FIG. 8, and is a line that passes through an origin at x=0 and is f(x)≥0 when x≥0.

In the present embodiment, the single dead zone value c is 0.2 from FIG. 5 and FIG. 8. In addition, the characteristic line is set as $f(x)=0.05\times^3$. The composite dead zone line g(x) is set as g(x)=f(x−c)+c by using the single dead zone value c and the characteristic line f(x). In the present embodiment, since the single dead zone value c is 0.2 and the characteristic line is $f(x)=0.05\times^3$, the composite dead zone line g(x) is $$g(x)=0.05\times(x-0.2)^3+0.2$$

It is to be noted that while the function representing the characteristic line is set as $f(x)=0.05\times^3$ in the present embodiment, the function representing the characteristic line is not limited to this. The function representing the characteristic line may, for example, be a biquadratic function or may be a quintic function as long as the width of the composite dead zone is set in such a shape as to be gradually widened as the operation amount in the one direction of the control lever is increased. As the order of the function is increased, the composite dead zone line deviates from the single dead zone value c at a position of a larger operation amount. In addition, the coefficient of the function is not limited to 0.05 either, but may, for example, be increased or decreased in a range of 0.03 to 0.07. The larger the coefficient, the larger an amount of deviation from the single dead zone value c.

The operation amount correcting section 45 performs correction calculation of the operation amounts of the control levers 12L and 13L by using the composite dead zone g(x) and the composite dead zone value c described above.

The demanded flow rate calculating section 42 calculates the respective demanded flow rates of the boom cylinder 4, the arm cylinder 5, the bucket cylinder 6, and the swing motor 7 as described earlier by using the corrected operation amounts.

As a result, as indicated by a solid line in FIG. 8, in the relation between the operation amounts (positions) of the control levers 12L and 13L and the operation of the actuators 4 to 7, the shape of the composite dead zone line as the boundary of the composite dead zone 82*a* or 82*b* is different from that indicated by a chain double-dashed line in FIG. 8. That is, when the operation amount correcting section 45 does not correct the operation amounts of the control levers 12L and 13L, the width of the composite dead zone 82*a* or 82*b* (value of the boundary of the composite dead zone 82*a* or 82*b*) is set on the basis of the dead zone of 20% of the demanded flow rate characteristics DFa to DFd shown in FIG. 5, and therefore the width of the composite dead zone is constant at 20%. On the other hand, when the operation amount correcting section 45 corrects the operation amounts of the control levers 12L and 13L as described above, the composite dead zone line is set by the characteristic line f(x), specifically, f(x)=0.05×3. Therefore, as indicated by a solid line in FIG. 8, the width of the composite dead zone has such a shape as to be gradually widened from 20% as the operation amount in the one direction of the control lever is increased.

The width of the composite dead zone thus has such a shape as to be gradually widened as the operation amount in the one direction of the control lever is increased. Consequently, as in the example of operation from point A to point B in FIG. 8, in a state in which a given actuator is driven by the hydraulic fluid delivered from a plurality of pumps, when the operator unintentionally performs a fine operation of the control lever of the other actuator, pump connection can be prevented from switching from the given actuator to the other actuator, and a decrease in work speed due to a decrease in actuator speed and the occurrence of an erroneous operation of the unintended actuator can be prevented.

Figure 9:
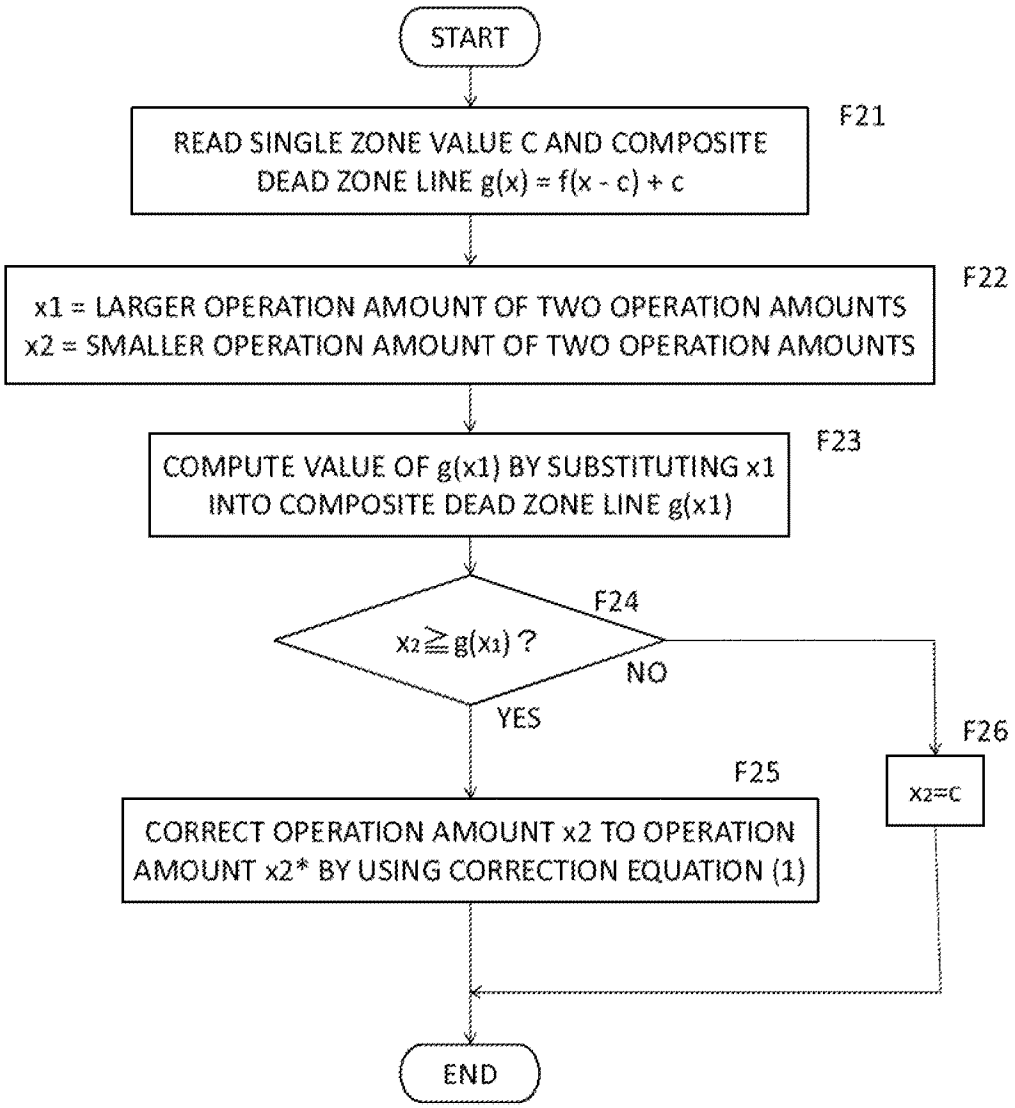
FIG. 9 is a flowchart showing processing contents of the operation amount correcting section.

FIG. 9 is a flowchart showing processing contents of the operation amount correcting section 45. The processing contents of the operation amount correcting section 45 will be described by using the flowchart of FIG. 9 and an example of operation of the hydraulic excavator.

First, the operation amount correcting section 45 reads the single dead zone value c and the composite dead zone line g(x)=f(x−c)+c from the composite dead zone setting section 44, in step F21.

Next, the operation amount correcting section 45 compares, for each of the control levers 12L and 13L, operation amounts in two directions of the control lever 12L or 13L (for example, an operation amount of arm crowding and an operation amount of right swing of the control lever 12L), and sets the larger operation amount as x1 and sets the smaller operation amount as x2, in step F22.

In the example of operation from point A to point B in FIG. 8, the operation amount of the arm crowding at point B is 100%, and the operation amount of the right swing at point B is 22%, and thus the operation amount of the arm crowding is larger than the operation amount of the right swing. Thus, x1=100%=1, and x2=22%=0.22.

In addition, as an operation example, a case is considered where in FIG. 8, the left control lever 12L is operated from a given point C (for example, the operation amount of the arm crowding is 80%, and the operation amount of the right swing is 8%) within the composite dead zone 82*a* to point D (for example, the operation amount of the arm crowding is 80%, and the operation amount of the right swing is 60%) within the composite operation region 83*a*. In this operation example, the operation amount of the arm crowding at operation point D is 80%, and the operation amount of the right swing at operation point D is 60%, and thus the operation amount of the arm crowding is larger than the operation amount of the right swing. Thus, x1=80%=0.8, and x2=60%=0.6.

Next, in step F23, the operation amount correcting section 45 substitutes x1 as the larger operation amount into the composite dead zone line g(x), and computes a value g(x1)=f(x1−c)+c on the composite dead zone line when x=x1.

In the example of operation from point A to point B in FIG. 8, $g(x1)=0.05\times(x1-0.2)^3+0.2$, and x1=1.0. Thus, the value g(x1) on the composite dead zone line is $g(x1)=0.05\times(1.0-0.2)^3+0.2=0.2256$.

In the example of operation from point C to point D in FIG. 8, $g(x1)=0.05\times(x1-0.2)^3+0.2$, and x1=0.8. Thus, the value g(x1) on the composite dead zone line is $g(x1)=0.05\times(0.8-0.2)^3+0.2=0.2108$.

In next step F24, the operation amount correcting section 45 determines whether or not x2 g(x1) for the smaller operation amount x2. This determination determines whether the operation point of the control lever 12L or 13L remains within the range of the composite dead zone 82*a* or 82*b* or whether the operation point of the control lever 12L or 13L has entered the composite operation region 83*a* or 83*b*. When x2 g(x1) (when the operation point has entered the composite operation region 83*a* or 83*b*), the processing proceeds to step F25, where the value of x2 is updated according to the correction equation to be described later. When x2 g(x1) does not hold (when the operation point is present within the range of the composite dead zone 82*a* or 82*b*), the processing proceeds to step F26, where the value of x2 is updated to the single dead zone value c (0.2 in the present operation example).

In the example of operation from point A to point B in FIG. 8, x2=0.22, and the value g(x1) on the composite dead zone line is 0.2256. Thus, x2<g(x1). Hence, the processing proceeds to step F26. Consequently, as described above, the connection of the hydraulic pumps can be prevented from switching from the arm cylinder 5 to the swing motor 7, and a decrease in work speed due to a decrease in the speed of the arm cylinder 5 and the occurrence of an erroneous operation of the unintended swing motor 7 can be prevented.

In the example of operation from point C to point D in FIG. 8, x2=0.6, and the value g(x1) on the composite dead zone line is 0.2108. Thus, x2>g(x1). Hence, the processing proceeds to step F25.

In step F25, the operation amount correcting section 45 computes an operation amount x2* as an updated value by using the following Equation (1) as the correction equation, and corrects the operation amount x2 to the operation amount x2*.

$$x2^*=\{(x1-c)/(x1-g(x1))\}\times x2+\{(c-g(x1))/(x1-g(x1))\}\times x1 \quad \text{Equation (1)}$$

In the example of operation from point C to point D in FIG. 8, the value of the operation amount x2* in the correction equation (1) is 0.5963, and the operation amount x2 is updated to this value.

Figure 10:
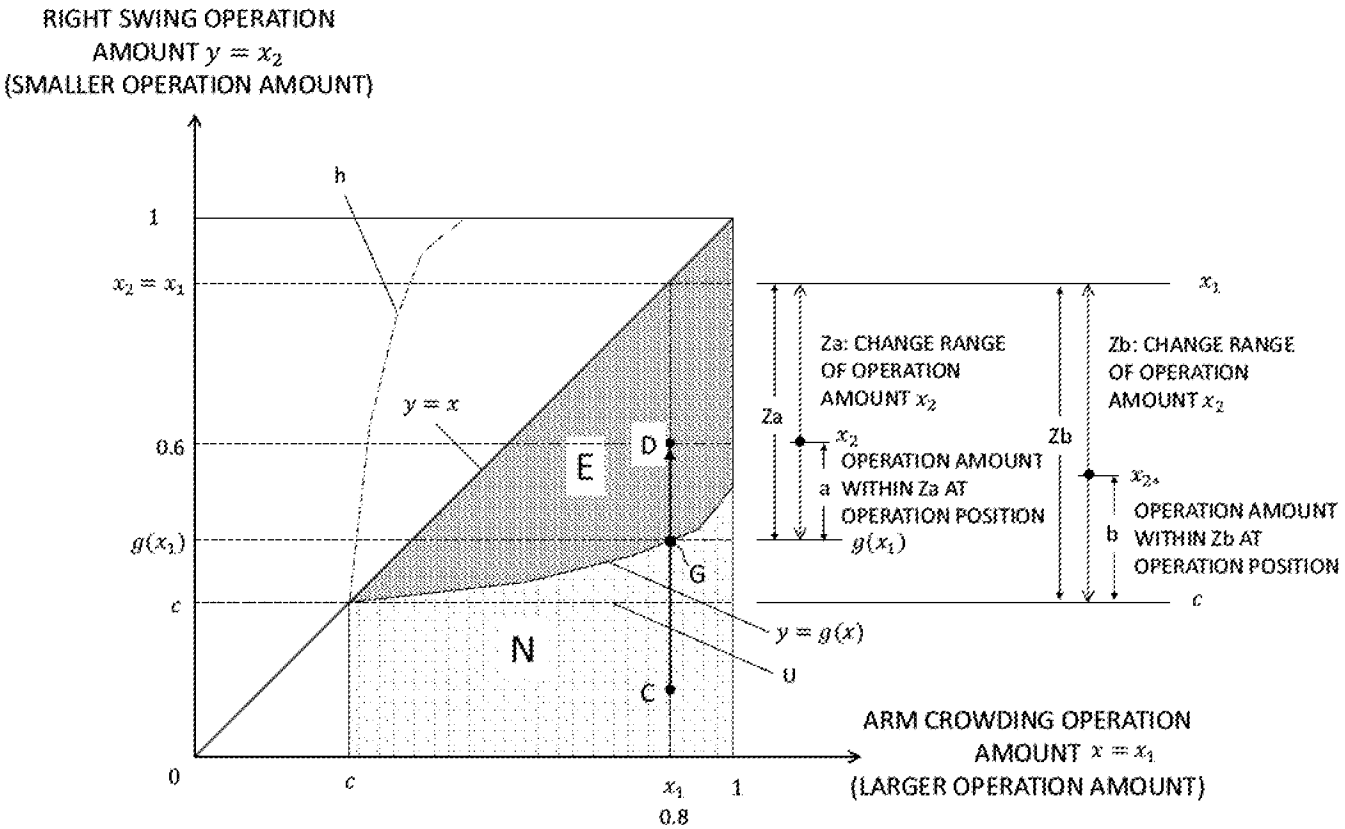
FIG. 10 is a diagram of assistance in explaining a correction equation (1), in which an axis of abscissas indicates the larger operation amount (an operation amount in a crowding direction of the arm cylinder in an operation example) of the operation amounts of two actuators of which operations are instructed by a same control lever, and an axis of ordinates indicates the smaller operation amount (an operation amount in a right swing direction of the swing motor in the operation example).

Here, the correction equation (1) used in step F25 will be described with reference to FIG. 10. FIG. 10 is a diagram of assistance in explaining the correction equation (1), in which an axis of abscissas indicates the larger operation amount x1 (the operation amount in the crowding direction of the arm cylinder 5 in the above-described operation example) of the operation amounts of the two actuators of which the operations are instructed by the same control lever, and an axis of ordinates indicates the smaller operation amount x2 (the operation amount in the right swing direction of the swing motor 7 in the above-described operation example). As described above, the example of operation from point C to point D in FIG. 8 is a case where the left control lever 12L is operated from a given operation point C (operation point at which the operation amount of the arm crowding is 80%, and the operation amount of the right swing is 8%) within the composite dead zone 82*a* to operation point D (operation point at which the operation amount of the arm crowding is 80%, and the operation amount of the right swing is 60%) within the composite operation region 83*a*. In addition, as described earlier, the composite dead zone line is y=g(x), and the single dead zone value is c. h1 denotes an imaginary composite dead zone line when the magnitude relation of x1 and x2 is reversed.

As in the example of operation from point A to point B in FIG. 8, when the operation amount x2 of the right swing is x2<g(x1), the operation amount x2 is located in the region of the composite dead zone N indicated by dots in the figure. When the operation amount x2 is located in the region of the composite dead zone N, the operator does not intent to drive the swing motor. Thus, the processing of steps F24 and F26 in FIG. 9 updates the operation amount x2 to the single dead zone value c even when the operation amount x2 is a value larger than the single dead zone value c. Incidentally, the updated value here may be set to be any value from zero to the single dead zone value c. This is because the swing motor 7 is not driven all the same.

When x2≥g(x1), the operation amount x2 enters the composite operation region E indicated by hatching in FIG. 10 (composite operation region for the smaller operation amount x2 of the two operation amounts x1 and x2). When the operation amount x2 is located in this region E, the operator intents to drive the swing motor 7. However, a change in the value of the operation amount x2 at a time of entering the composite operation region E beyond the composite dead zone line g(x) becomes a problem. Specifically, when correction processing to be described hereafter (processing of step F25 in FIG. 9) is not performed, the swing motor 7 is not driven even when the operation amount x2 of the right swing is brought close to the composite dead zone line g(x1) from zero while the operation amount x1 of the arm crowding is constant, but the value of the operation amount x2 changes from zero to the value of g(x1) at an instant that the operation amount x2 reaches point G on the composite dead zone line g(x1). Consequently, the demanded flow rate calculating section 42 calculates the demanded flow rate corresponding to the value g(x1) of the operation amount x2, and a speed at a start of movement of the swing motor 7 changes abruptly.

Accordingly, in step F25 in FIG. 9, the operation amount correcting section 45 uses, as the above-described correction equation (1), a conversion equation derived by making a ratio of the operation amount x2 in a change range (g(x1)≤x2≤x1) of the operation amount x2 in the composite operation region E in the case where the composite dead zone line g(x) is set correspond to a ratio of the operation amount x2 in a change range (c≤x2≤x1) of the operation amount x2 in a composite operation region when a composite dead zone line U that makes the width of the composite dead zone constant at the single dead zone value c is set, and corrects the operation amount x2 such that the demanded flow rate of the swing motor 7 increases from zero.

In addition, the correction amount correcting section 45 derives the correction equation (1) by using data read in step F21 in FIG. 9 (the single dead zone value c and the composite dead zone line g(x)=f(x−c)+c).

Here, the correction equation (1) corrects the operation amount x2 of the control lever 12L or 13L such that when the control lever 12L or 13L is operated beyond the composite dead zone line g(x) to a given position (for example, operation point D) within the composite operation region E, the ratio of the operation amount x2 at the given position within the change range of the operation amount x2 in the composite operation region E is equal to the ratio of the operation amount x2 at the given position within the change range of the operation amount x2 in the composite operation region in the case where the composite dead zone line U that makes the width of the composite dead zone 82*a* or 82*b* constant is set, and the demanded flow rate of the actuator increases from zero.

Description will be made concretely. In FIG. 10, let Za be the change range of the operation amount x2 which corresponds to the operation amount x1 in the composite operation region E in the case where the composite dead zone line g(x) is set, and let Zb be the change range of the operation amount x2 which corresponds to the operation amount x1 in the composite operation region in the case where the composite dead zone line U that makes the width of the composite dead zone constant at the single dead zone value c is set. In addition, let a be the operation amount x2 at a given operation position (for example, operation point D in the above-described operation example) within the change range Za of the operation amount x2 in the composite operation region E, and let b be the operation amount x2 at given operation position (for example, operation point D in the above-described operation example) within the change range Zb of the operation amount x2 in the composite operation region in the case where the width of the composite dead zone is constant at the single dead zone value c. In order for the actuator corresponding to the operation amount x2 (for example, the swing motor 7) to start to move smoothly when the operation amount x2 enters the composite operation region E beyond the composite dead zone line g(x), it suffices to correct the operation amount x2 to the single dead zone value c when the operation amount x2 reaches point G on the composite dead zone line g(x1). For this purpose, it suffices to derive the correction equation such that the ratio of the operation amount a at the given operation position within the change range Za is equal to the ratio of the operation amount b at the given operation position within the change range Zb, compute the operation amount x2* (to be described later), and correct the operation amount x2 to the operation amount x2*. A process of deriving the correction equation at this time is as follows.

The ratio of the operation amount a at the given operation position within the change range Za of the operation amount x2 is expressed by Operation Amount a/Change Range Za The ratio of the operation amount b at the given operation position within the change range Zb is expressed by Operation Amount b/Change Range Zb Thus, in order to make the ratios equal to each other, it suffices for the following relation to hold.

$$\text{Operation Amount } a/\text{Change Range } Za=\text{Operation Amount } b/\text{Change Range } Zb \qquad \text{Equation (2)}$$

Here, when the operation amount x2 at the given operation position within the change range Zb is set as a correction value x2*, the operation amount in the change range Za, the operation amount a, the operation amount in the change range Zb, and the operation amount b can each be expressed as follows.

$$\text{Operation Amount in Change Range } Za=x1-g(x1)$$

$$\text{Operation Amount } a=x2-g(x1)$$

$$\text{Operation Amount in Change Range } Zb=x1-c$$

$$\text{Operation Amount } b=x2^*-c$$

A conversion equation for obtaining the operation amount x2* (a correction value of x2, that is, an updated value of x2) is derived as follows by substituting the above equations into Equation (2).

$$x2^*=\{(x1-c)/(x1-g(x1))\}\times x2+\{(c-g(x1))/(x1-g(x1))\}\times x1$$

The correction equation (1) is thus derived.

Figure 11A:
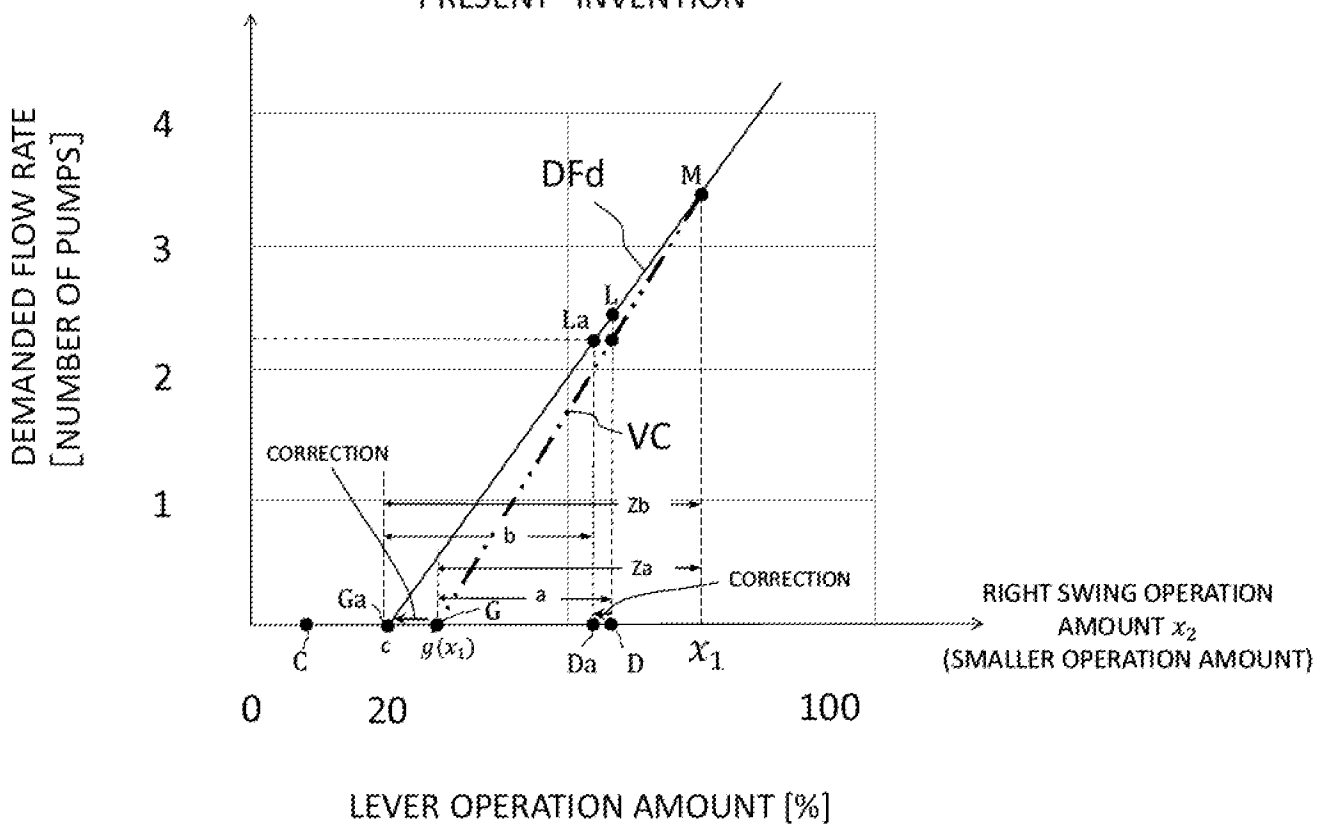
FIG. 11A is a diagram showing, in association with a demanded flow rate characteristic, a change in a demanded flow rate when a control lever is operated in case where an operation amount is corrected.

FIG. 11A is a diagram showing, in association with the demanded flow rate characteristic DFd shown in FIG. 5, a change in the demanded flow rate when the left control lever 12L is operated from the above-described operation point C (operation point at which the operation amount of the arm crowding is 80%, and the operation amount of the right swing is 8%) to operation point D (operation point at which the operation amount of the arm crowding is 80%, and the operation amount of the right swing is 60%) in the case where the operation amount x2 is corrected as described above. FIG. 11A illustrates a case where the operation amount x2 at operation point D within the change range Za when the composite dead zone line g(x) is set is assumed to be an operation amount corresponding to a demanded flow rate of 2.2. VC is an imaginary demanded flow rate characteristic set such that the demanded flow rate at point G on the composite dead zone line g(x) is zero when the composite dead zone line g(x) is set.

As described in step F26 in FIG. 9, in the present embodiment, when the operation amount x2 reaches point G on the composite dead zone line g(x1), the operation amount x2 is updated to the single dead zone value c by the correction equation (1). At this time, in FIG. 11A, the operation amount x2 at point G is corrected to the single dead zone value c at point Ga, as indicated by an arrow. In addition, when x2>g(x1), and thus the operation amount x2 enters the composite operation region E indicated by hatching in FIG. 10, the operation amount x2 is updated to x2* by the correction equation (1). When the operation amount x2 reaches operation point D, the operation amount x2 is corrected to a value at point Da, as indicated by an arrow in FIG. 11A. When the thus corrected operation amount x2* changes from point Ga (zero) to operation point Da in FIG. 11A, the demanded flow rate increases from point Ga (zero) to a value at point La corresponding to the operation amount at operation point Da along the demanded flow rate characteristic DFd. The change in the demanded flow rate in this case is equivalent to that when the demanded flow rate is computed from the operation amount x2 by using the imaginary demanded flow rate characteristic VC.

Figure 11B:
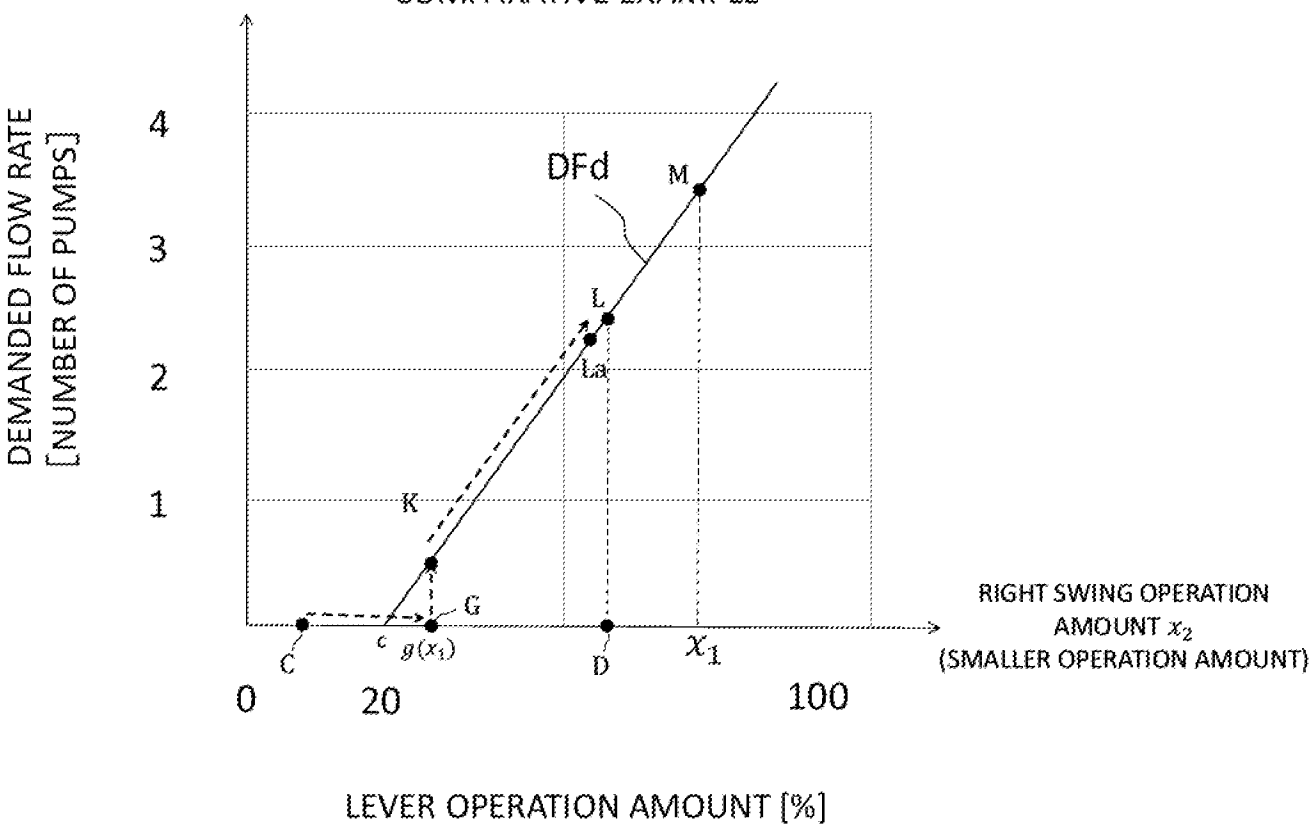
FIG. 11B is a diagram showing, in association with the demanded flow rate characteristic, a change in the demanded flow rate when the control lever is operated in a comparative example in which the operation amount is not corrected.

FIG. 11B is a diagram showing, in association with the demanded flow rate characteristic DFd shown in FIG. 5, a change in the demanded flow rate when the left control lever 12L is operated from the above-described operation point C to operation point D in a comparative example in which the operation amount x2 is not corrected.

In the comparative example in which the operation amount x2 is not corrected, as shown in FIG. 11B, at an instant that the operation amount x2 reaches the composite dead zone line g(x1), the demanded flow rate increases from zero to a value at point K on the demanded flow rate characteristic DFd, and thereafter increases to a value at point L corresponding to the operation amount at operation point D along the demanded flow rate characteristic DFd. Therefore, in the comparative example in which the operation amount x2 is not corrected, a rise in actuator speed when a composite operation is started becomes sharp. In the present embodiment, the demanded flow rate when the operation amount x2 reaches the composite dead zone line g(x1) is zero, and therefore a speed variation at a start of movement of the actuator when the composite operation is started can be suppressed.

In addition, even when composite dead zone line g(x1) is used, the demanded flow rate increases along the demanded flow rate characteristic DFd, and therefore the demanded flow rate can be increased from zero smoothly.

As described above, according to the present embodiment, in a state in which a given actuator is driven by the hydraulic fluid delivered from a plurality of pumps, when the operator unintentionally performs a fine operation of the control lever of the other actuator, pump connection can be prevented from switching from the given actuator to the other actuator, and a decrease in work speed due to a decrease in actuator speed and the occurrence of an erroneous operation of the unintended actuator can be prevented.

In addition, a rise in actuator speed when the operation amount of the control lever of the given actuator enters the composite operation region from the composite dead zone and thus a composite operation is started can be prevented from becoming sharp, and the demanded flow rate can be increased from zero smoothly.

Incidentally, while the correction equation (1) is derived by making the operation amount x2 within the change range Za linearly correspond to the operation amount x2* within the change range Zb in the above-described Equation (2), the correction equation may be derived by making the operation amount x2 within the change range Za nonlinearly correspond to the operation amount x2* within the change range Zb such that the imaginary demanded flow rate characteristic VC shown in FIG. 11A is an upwardly projecting or downwardly projecting curve. Consequently, when the imaginary demanded flow rate characteristic VC is an upwardly projecting curve, the imaginary demanded flow rate characteristic VC smoothly intersects the demanded flow rate characteristic DFd at a point M of intersection of the imaginary demanded flow rate characteristic VC and the demanded flow rate characteristic DFd, and thus a change in actuator speed when the operation amount increases beyond x1 can be suppressed. In addition, when the imaginary demanded flow rate characteristic VC is a downwardly projecting curve, a change in the demanded flow rate when the demanded flow rate rises from zero can be made gentler, and a rise in actuator speed when a composite operation is started can be made smoother.

Second Embodiment

Figure 12:
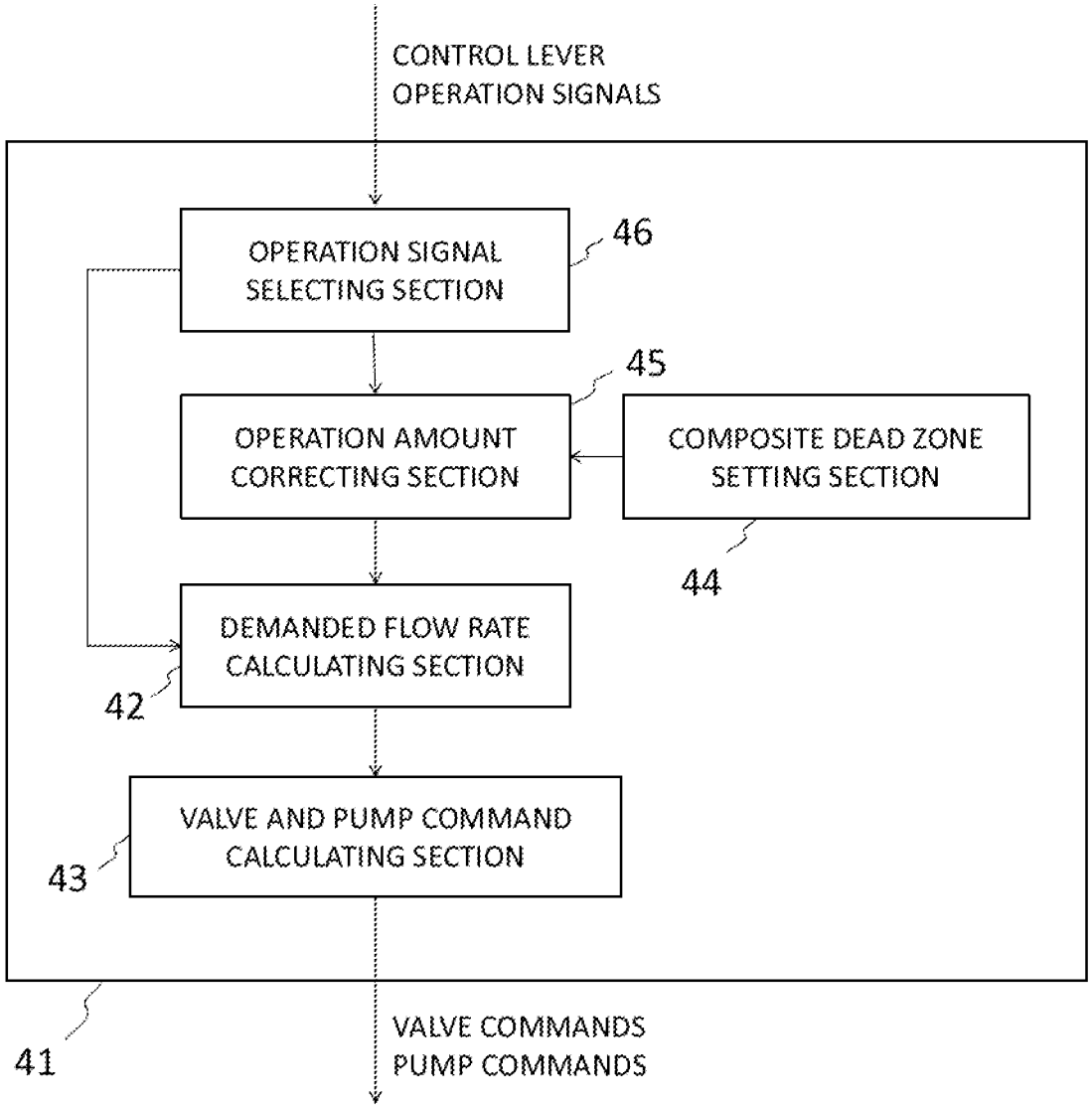
FIG. 12 is a functional block diagram showing processing functions of a controller included in a construction machine (hydraulic excavator) in a second embodiment of the present invention.

FIG. 12 is a functional block diagram showing processing functions of a controller 41 included in a construction machine (hydraulic excavator) in a second embodiment of the present invention.

In the present embodiment, the controller 41 includes an operation signal selecting section 46 in addition to the demanded flow rate calculating section 42, the valve and pump command calculating section 43, the composite dead zone setting section 44, and the operation amount correcting section 45.

Figure 13:
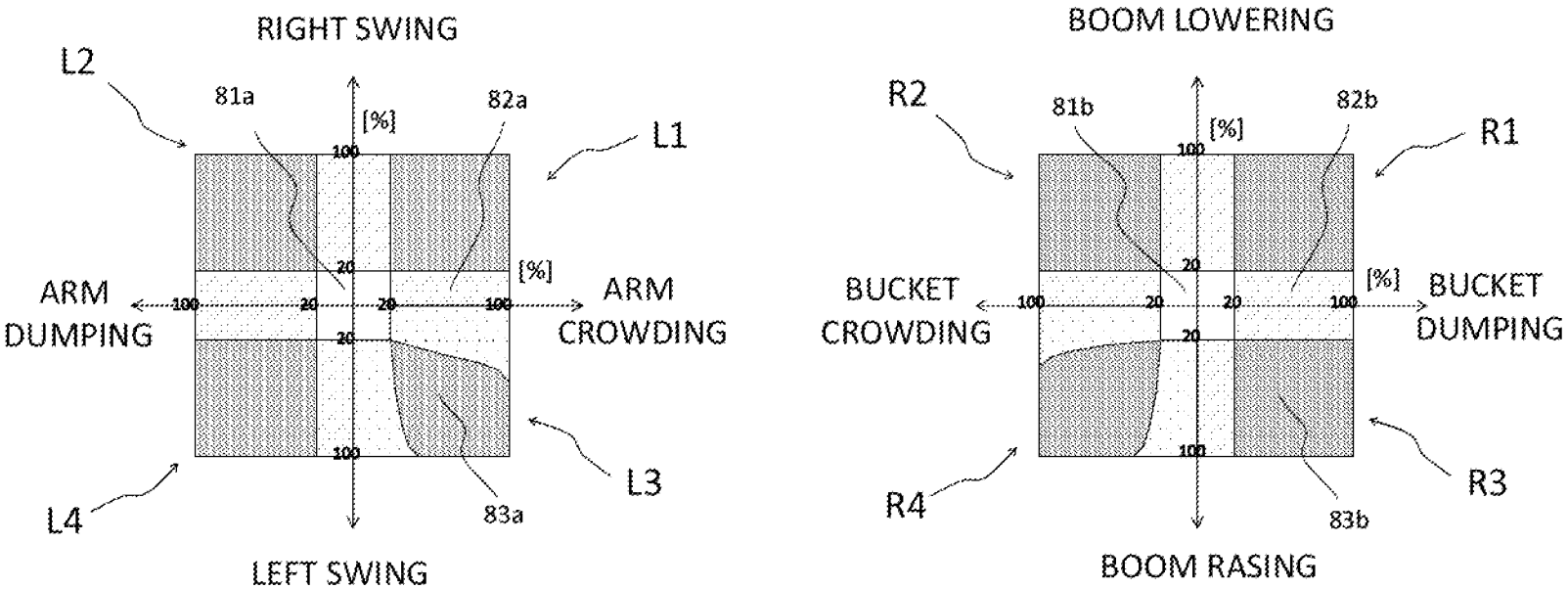
FIG. 13 is a diagram showing relation between the operation amounts (positions) of the control levers and the operation of the actuators, where the operation amounts of the control levers are corrected in the second embodiment.

FIG. 13 is a diagram showing relation between the operation amounts (positions) of the control levers 12L and 13L and the operation of the actuators 4 to 7 when the operation amounts obtained from the operation signals of the control levers 12L and 13L are corrected in the present embodiment.

In FIG. 12, differences from the processing functions of the controller 41 shown in FIG. 4 are the following two points. The first point is that the operation signal selecting section 46 is provided, the operation signal selecting section 46 selects specific operation signals set in advance among the operation signals of the four actuators of the control levers 12L and 13L, the operation amount correcting section 45 corrects only the operation amounts of the selected specific operation signals, and thereafter the demanded flow rate calculating section 42 computes demanded flow rates. In this case, operation signals not selected by the operation signal selecting section 46 are sent to the demanded flow rate calculating section 42, and the demanded flow rate calculating section 42 computes demanded flow rates using the operation amounts of the operation signals as they are. A second point is that the function of the composite dead zone line g(x) used when the operation amount correcting section 45 corrects only the operation amounts of the selected operation signals is made different according to the kinds of the operation amounts. For this purpose, in the composite dead zone setting section 44, a plurality of kinds of characteristic line functions f(x) (for example, two kinds of f1(x) and f2(x)) are prepared, and by using the plurality of kinds of functions, a plurality of kinds of functions of the composite dead zone line g(x) (for example, two kinds of g1(x) and g2(x)) are set.

By thus changing the processing functions of the controller 41, it is possible to set the composite dead zones 82*a* and 82*b* and the composite operation regions 83*a* and 83*b* having composite dead zone lines as shown in FIG. 13.

In FIG. 13, a left diagram shows relation between the position of the left control lever 12L and actuator operation, and a right diagram shows relation between the position of the right control lever 13L and actuator operation. Four operation quadrants L1 to L4 and R1 to R4 are generated by each of the left and right control levers 12L and 13L. In each of the operation quadrants L1 to L4 and R1 to R4, a rectangular region shown in white in the figure represents a region in which neither of the two actuators operates, a region indicated by dots represents a region in which one of the actuators operates (composite dead zones 82*a* and 82*b*), and a region indicated by hatching represents a region in which both of the two actuators operate (composite operation regions 83*a* and 83*b*).

In the present embodiment, the operation signal selecting section 46 is provided as described above, the setting information of the composite dead zone setting section 44 is changed, and the function of the composite dead zone line g(x) used by the operation amount correcting section 45 is made different according to the kinds of operation amounts. Thus, as shown in FIG. 13, the controller 41 sets the composite dead zone line y=g(x) different for each of the left control lever 12L and the right control lever 13L and for each of the four operation quadrants L1 to L4 or R1 to R4. Incidentally, the composite dead zone line y=g(x) different for either each of the left control lever 12L and the right control lever 13L or each of the four operation quadrants L1 to L4 or R1 to R4 may be set. It is thereby possible to set an optimum composite dead zone line in consideration of the operation characteristics of the actuators of which the operations are instructed by the control levers, positional relation between the operator and the levers, a degree of mastery of the operator, and lever characteristics such as the repulsive forces of the levers and the like.

It is to be noted that the composite dead zone lines shown in FIG. 13 are an example, and that the composite dead zone lines can be designed optionally according to positional relation between the operator and the levers, a degree of mastery of the operator, the repulsive forces of the levers, and the like.

It is to be noted that the present invention is applicable also to construction machines other than hydraulic excavators, for example, construction machines such as wheeled excavators, wheel loaders, and the like.

DESCRIPTION OF REFERENCE CHARACTERS

1A: Front implement
1B: Upper swing structure
1C: Lower track structure
1: Boom
2: Arm
3: Bucket
4: Boom cylinder
5: Arm cylinder
6: Bucket cylinder
P1 to P4: Closed circuit pump
V11 to V44: Selector valve
A1 to A4: Actuator
12, 13: Control lever device (operation device)
12L, 13L: Control lever
41: Controller
42: Demanded flow rate calculating section
43: Valve and pump command calculating section
44: Composite dead zone setting section
c: Single dead zone value
g(x): Composite dead zone line
45: Operation amount correcting section
46: Operation signal selecting section
DFa to DFd: Demanded flow rate characteristic
PT: Priority table
81*a*, 81*b*: Neutral dead zone
82*a*, 82*b*: Composite dead zone
83*a*, 83*b*: Composite operation region
E: Composite operation region for a smaller operation amount of operation amounts in two operating directions

The invention claimed is:

1. A construction machine comprising:

a plurality of closed circuit pumps;

a plurality of regulators that adjusts displacements of the plurality of closed circuit pumps;

a plurality of actuators connected in closed circuits to the plurality of closed circuit pumps;

a plurality of selector valves that are respectively arranged between the plurality of closed circuit pumps and the plurality of actuators, and switches interruption and communication of the respective closed circuits between the plurality of closed circuit pumps and the plurality of actuators;

a plurality of operation devices that generate instructions for operation of the plurality of actuators; and a controller that receives operation signals from the plurality of operation devices, calculates demanded flow rates of the plurality of actuators on a basis of respective operation amounts of the plurality of operation devices calculated from the operation signals and a plurality of demanded flow rate characteristics set in advance, and controls the plurality of selector valves and the plurality of regulators according to the demanded flow rates, wherein the plurality of operation devices include a control lever device that enables generation of instructions for operation of two actuators by one control lever, the control lever device is configured to generate an instruction for operation of one of the two actuators when the control lever is operated in a first direction, and generate an instruction for operation of other one of the two actuators when the control lever is operated in a second direction orthogonal to the first direction, and the controller is configured to, in case where an operation component in the other direction is contained when the control lever is operated in one of the first and second directions, generate a composite dead zone in which the one actuator is operated by the operation of the control lever in the one direction and an operation of the other actuator is disabled by the operation of the control lever in the other direction, on a basis of the demanded flow rate characteristics corresponding to the two actuators among the plurality of demanded flow rate characteristics, and when the control lever is operated in the first and second directions beyond the composite dead zone, generate a composite operation region in which the two actuators are operated on the basis of the demanded flow rate characteristics corresponding to the two actuators, and wherein the controller is further configured to set a composite dead zone line as a boundary between the composite dead zone and the composite operation region such that a width of the composite dead zone corresponding to an operation amount in the other direction of the control lever of the control lever device is widened as an operation amount in the one direction of the control lever is increased, and correct the operation amount in the other direction such that the demanded flow rate of the actuator driven by the operation in the other direction increases from zero, when the control lever is operated in the other direction in a state in which the operation amount in the one direction of the control lever remains within a range of the composite dead zone, and the operation amount in the other direction exceeds the composite dead zone line.

2. The construction machine according to claim 1, wherein the controller is configured to, when the control lever is operated in the other direction to a given position within the composite operation region beyond the composite dead zone line, generate a correction equation that makes a ratio of an operation amount at the given position within a change range of the operation amount in the other direction in the composite operation region equal to a ratio of an operation amount at the given position within a change range of the operation amount in the other direction in the composite operation region in case where a composite dead zone line that makes the width of the composite dead zone constant is set, and correct the operation amount in the other direction by using the correction equation.

3. The construction machine according to claim 1, wherein the controller is configured to, when the control lever is operated in the other direction in a state in which the operation amount in the one direction of the control lever remains within the range of the composite dead zone, and the operation amount in the other direction reaches the composite dead zone line, correct the operation amount in the other direction such that the demanded flow rate of the actuator driven by the operation in the other direction is zero and the demanded flow rate of the actuator driven by the operation in the other direction increases along the demanded flow rate characteristic corresponding to said actuator as the operation amount increases beyond the composite dead zone line.

4. The construction machine according to claim 1, wherein the plurality of control lever devices are left and right control lever devices installed in left and right front portions of a cab seat of the construction machine, and the controller is configured to set, in four operation quadrants generated by the left and right control levers, at least one of the composite dead zone lines different for the left and right control levers and the composite dead zone lines different for the four operation quadrants.

5. The construction machine according to claim 1, wherein the controller is configured to set the composite dead zone line by using a characteristic line expressed by a function having an order of 3 to 5 and having a coefficient in a range of 0.03 to 0.07.

* * * * *